US008514157B2

(12) United States Patent
Tsuchi

(10) Patent No.: US 8,514,157 B2
(45) Date of Patent: Aug. 20, 2013

(54) DIFFERENTIAL AMPLIFIER

(75) Inventor: Hiroshi Tsuchi, Tokyo (JP)

(73) Assignees: NEC Corporation (JP); NEC Electronics Corporation (JP)

( * ) Notice: Subject to any disclaimer, the term of this patent is extended or adjusted under 35 U.S.C. 154(b) by 1157 days.

(21) Appl. No.: 10/976,289

(22) Filed: Oct. 27, 2004

(65) Prior Publication Data

US 2005/0088390 A1 Apr. 28, 2005

(30) Foreign Application Priority Data

Oct. 27, 2003 (JP) ..... 2003-365639

(51) Int. Cl.
*G09G 3/36* (2006.01)

(52) U.S. Cl.
USPC ..... 345/89; 345/30; 345/55; 345/84; 345/87

(58) Field of Classification Search
None
See application file for complete search history.

(56) References Cited

U.S. PATENT DOCUMENTS

| | | | | |
|---|---|---|---|---|
| 4,468,629 | A * | 8/1984 | Choma, Jr. | 330/260 |
| 4,757,275 | A * | 7/1988 | Saller et al. | 330/261 |
| 5,381,052 | A * | 1/1995 | Kolte | 327/60 |
| 5,396,245 | A | 3/1995 | Rempfer | 341/145 |
| 5,623,279 | A * | 4/1997 | Itakura et al. | 345/98 |
| 6,246,351 | B1 | 6/2001 | Yilmaz | 341/145 |
| 6,356,152 | B1 | 3/2002 | Jezdic et al. | 330/253 |

FOREIGN PATENT DOCUMENTS

| | | |
|---|---|---|
| CN | 1365185 A | 8/2002 |
| CN | 1441547 A | 3/2003 |
| JP | 9-064746 | 3/1997 |
| JP | 9-232961 | 9/1997 |
| JP | 2000-183747 | 6/2000 |
| JP | 2001-34234 | 2/2001 |
| JP | 2001-313568 | 11/2001 |
| JP | 2001-343948 | 12/2001 |

OTHER PUBLICATIONS

Chinese Office Action dated Nov. 9, 2007 with English translation.
Japanese Office Action dated Nov. 11, 2008 (with English translation of relevant parts).

* cited by examiner

*Primary Examiner* — Sumati Lefkowitz
*Assistant Examiner* — Jesus Hernandez
(74) *Attorney, Agent, or Firm* — Ostrolenk Faber LLP

(57) ABSTRACT

A differential amplifier has first and second input terminals (T1, T2), an output terminal, a differential stage connected to the first and second input terminals, and an amplification stage having an input terminal thereof connected to an output terminal of the differential stage and an output terminal thereof connected to the output terminal. The differential stage includes a first differential pair with one of an input pair thereof connected to the first input terminal (T1) and the other connected to the output terminal, a second differential pair with one of an input pair thereof connected to the first input terminal (T1) and the other connected to the second input terminal (T2), a first current source for supplying current to the first differential pair, a second current source for supplying current to the second differential pair, and a load circuit connected to the output pairs of the first and second differential pairs. One of the output pair of the first differential pair is connected in common to one of the output pair of the second differential pair, and their common connection node constitutes the output terminal of the differential stage.

2 Claims, 39 Drawing Sheets

FIG . 20

| LEVEL | INPUT VOLTAGE | V(T1) | V(T2) | D1,D0 |
|---|---|---|---|---|
| 1 | | A | B | 0,0 |
| 2 | A | A | A | 0,1 |
| 3 | B | B | B | 1,0 |
| 4 | | B | A | 1,1 |

NUMBER OF INPUT VOLTAGES : 2

NUMBER OF TRANSISTORS : 4

FIG . 23

| LEVEL | INPUT VOLTAGE | V(T1) | V(T2) | (D3,D2,D1,D0) |
|---|---|---|---|---|
| 1 | | A | B | 0,0,0,0 |
| 2 | A | A | A | 0,0,0,1 |
| 3 | B | B | B | 0,0,1,0 |
| 4 | | B | A | 0,0,1,1 |
| 5 | | C | D | 0,1,0,0 |
| 6 | C | C | C | 0,1,0,1 |
| 7 | D | D | D | 0,1,1,0 |
| 8 | | D | C | 0,1,1,1 |
| 9 | | E | F | 1,0,0,0 |
| 10 | E | E | E | 1,0,0,1 |
| 11 | F | F | F | 1,0,1,0 |
| 12 | | F | E | 1,0,1,1 |
| 13 | | G | H | 1,1,0,0 |
| 14 | G | G | G | 1,1,0,1 |
| 15 | H | H | H | 1,1,1,0 |
| 16 | | H | G | 1,1,1,1 |

| | |
|---|---|
| NUMBER OF INPUT VOLTAGES | :8 |
| NUMBER OF TRANSISTORS | :16 |

FIG . 37 PRIOR ART

| LEVEL | INPUT | (Vp1,Vp2) | (D3,D2,D1,D0) |
|---|---|---|---|
| 1 | A | AA | 0,0,0,0 |
| 2 | | AB | 0,0,0,1 |
| 3 | B | BB | 0,0,1,0 |
| 4 | | BC | 0,0,1,1 |
| 5 | C | CC | 0,1,0,0 |
| 6 | | CD | 0,1,0,1 |
| 7 | D | DD | 0,1,1,0 |
| 8 | | DE | 0,1,1,1 |
| 9 | E | EE | 1,0,0,0 |
| 10 | | EF | 1,0,0,1 |
| 11 | F | FF | 1,0,1,0 |
| 12 | | FG | 1,0,1,1 |
| 13 | G | GG | 1,1,0,0 |
| 14 | | GH | 1,1,0,1 |
| 15 | H | HH | 1,1,1,0 |
| 16 | | HI | 1,1,1,1 |
| 17 | I | II | |

※ VP1 AND VP2 ARE IN RANDOM ORDER

NUMBER OF INPUT VOLTAGES :16

NUMBER OF TRANSISTOR :30

DIFFERENTIAL AMPLIFIER

FIELD OF THE INVENTION

The present invention relates to a differential amplifier. More specifically, the invention relates to a differential amplifier suitable for being applied to a data driver in a liquid crystal display device and the like, and a display device that uses it.

BACKGROUND OF THE INVENTION

Recently, a liquid crystal display device (LCD), featured by thin thickness, lightness of weight and low power consumption, has become popular as a display device, and is now in use for a display device of a mobile information terminal device, such as a portable telephone set (mobile phone or cellular phone), PDA (personal digital assistant) or a notebook PC.

However, the technique for enlarging the size of the liquid crystal display device or for coping with moving pictures has advanced such that not only the LCD for mobile use but also the stationary type large screen display device or a large screen liquid crystal television receiver has become a reality. As the liquid crystal display device, a liquid crystal device of an active matrix driving system, providing for high definition display, is currently in use.

Referring first to FIG. 29, a typical configuration of the liquid crystal display device of the active matrix driving system is explained. In FIG. 29, the major configuration of the connected to a pixel of a liquid crystal display unit is schematically shown by an equivalent circuit.

In general, a display unit 960 of a liquid crystal display device of the active matrix driving system is made up by a semiconductor substrate, including a matrix array of transparent pixel electrodes 964 and thin-film transistors (TFTs) 963, a counter-substrate having a transparent electrode 966 on the entire surface, and a liquid crystal sealed in-between the two substrates. The semiconductor substrate includes the matrix array of 1280×3 columns of pixels by 1024 rows of pixels in the case of a color SXGA panel, as an example.

The TFT 963, having the switching function, has its on/off controlled by the scanning signal, such that, when the TFT 963 is turned on, the grayscale voltage corresponding to a video signal is applied to the pixel electrode 964, and the liquid crystal has its transmittance changed by the potential difference across the pixel electrodes 964 and the electrode of the counter-substrate 966. This potential difference is maintained by a liquid crystal capacitance 965 for a preset time to display a picture.

On the semiconductor substrate, data lines 962 for sending a plurality of levels of voltage (grayscale voltages) applied to the respective pixel electrodes 964 and scanning lines 961 each for sending the scanning signal are arranged in a lattice form (in the case of the color SXGA panel, 1280×3 data lines and 1024 scanning lines are arranged). The scanning lines 961 and the data lines 962 become large capacitive loads due to capacitances generated at mutual intersections and liquid crystal capacitances sandwiched with the opposed substrate electrode.

The scanning signal is supplied to a scanning line 961 by a gate driver 970, and supply of the grayscale voltage to each of the pixel electrodes 964 is performed from a data driver 980 through a data line 962.

Rewriting of data for one screen is performed in one frame period (1/60 seconds), and each pixel row (each line) is selected one by one for each scanning line. The grayscale voltage is supplied from each data line within the period of the selection.

While the gate driver 970 should supply at least a binary scanning signal, the data driver 980 needs to drive the data lines by multi-levels of grayscale voltages corresponding to the number of grayscales. For this reason, as the buffer unit of the data driver 980, a differential amplifier that can perform voltage output with high precision is employed.

Further, in recent years, higher picture quality (creation of multiple colors) has been pursued, so that the demand for at least 260 thousand colors (6-bit video data for each of RGB), and further the demand for 26,800 thousand colors (8-bit video data for each of RGB) or more have increased.

For this reason, the data driver that outputs grayscale voltages corresponding to multi-bit video data is required to perform voltage output with an extremely high degree of precision. Further, the number of devices in a circuit unit for processing the video data has increased, and a chip area in a data driver LSI has increased, thereby becoming a factor causing higher cost. This problem will be described below in detail.

FIG. 30 is a diagram showing a configuration of the data driver 980 in FIG. 29, and shows the pertinent portion of the data driver 980 in the form of blocks. Referring to FIG. 30, the data driver 980 includes a latch address selector 981, a latch 982, a grayscale voltage generating circuit 983, a plurality of decoders 984, and a plurality of buffer circuits 985.

The latch address selector 981 determines a timing of a data latch based on a clock signal CLK. The latch 982 latches digital video data based on the timing determined by the latch address selector 981, and outputs latched data to each of the decoders 984 in unison according to an STB (strobe) signal. The grayscale voltage generating circuit 983 generates grayscale voltages with the number of grayscales corresponding to the video data. Each decoder 984 selects one of the grayscale voltages corresponding to the input data, for output. Each buffer circuit 985 inputs the grayscale voltage output from the decoder 984, and current amplifies the input grayscale voltage, for output as an output voltage Vout.

When 6-bit video data is input, for example, the number of grayscales is 64. Thus, the grayscale voltage generating circuit 983 generates grayscale voltages at 64 levels. Each decoder includes a circuit for selecting one of the grayscale voltages at 64 levels.

On the other hand, when 8-bit video data is input, the number of grayscales becomes 256. Thus, the grayscale voltage generating circuit 983 generates grayscale voltages at 256 levels. Each decoder includes a circuit for selecting one of the grayscale voltages at 256 levels.

When multiple bits are used in this manner, the circuit sizes of the grayscale voltage generating circuit 983 and the decoders 984 increase. When an increase from six bits to eight bits is made, the circuit sizes become four times or larger. Accordingly, the chip area of the LSI of the data driver increases to bring about a higher cost due to use of multiple bits.

On contrast therewith, configurations that restrict an increase in the chip area of the data driver LSI to a minimum even if multiple bits are used are proposed in patent documents 1 and 2, which will be hereinafter described. FIG. 31 shows an example of the configuration proposed in patent document 1 which will be hereinafter described (corresponding to FIG. 16 in patent document 1 that will be hereinafter described).

Referring to FIG. 31, this data driver is different from the data driver shown in FIG. 30 in the configurations of the grayscale voltage generating circuit 986, decoders 987, and buffer circuits 988. In the data driver in FIG. 31, the grayscale voltage generating circuit 986 generates a grayscale voltage each for two grayscales, and reduces the number of grayscale voltage lines for the decoders 987 to about a half of those for the decoders 984 in FIG. 31. Each decoder 987 selects two grayscale voltages according to video data, for output to a buffer circuit 988. The buffer circuit 988 can current amplifies input two grayscale voltages and a grayscale voltage intermediate between the two grayscale voltages, for output.

Proposals by the hereinafter-described patent documents 1 and 2 are to halve the number of grayscale voltage lines for each decoder 987, reduce the circuit size of the decoders 987, and aim at implementation of area saving or lower cost, by including the buffer circuits 988 inputting two grayscale voltages and outputting one of the two grayscale voltages and their intermediate voltage. Accordingly, even if multiple bits are used, an increase in the chip area of the data driver LSI can be more or less restricted.

As the differential amplifiers suitable for the buffer circuits 988, configurations shown in FIG. 5B in the hereinafter-described patent document 1 and shown in FIG. 15 in the hereinafter-described patent document 2 are proposed. In the configuration shown in FIG. 5B in the hereinafter-described patent document 1, the output of the differential pair becomes the input terminal of a diode-connected current mirror, so that it is considered that the configuration does not function as the differential amplifier. From FIG. 15 in the hereinafter-described patent document 2 pertinent to the hereinafter-described patent document 1, it is conjectured that the typical characteristic of the differential amplifiers proposed in the hereinafter-described patent documents 1 and 2 resides in a differential amplifier having a differential stage 910, as shown in FIG. 32, for example (based on the result of study by the inventor of the present invention).

FIG. 32 shows a configuration of the two-input differential amplifier. The differential stage 910 is characterized in that each of transistors 901 and 902 constituting a first differential pair is connected in parallel with transistors 903 and 904 constituting a second differential pair. Each of the differential pairs is driven by a common current source 907. Gray-scale voltages Vp1 and Vp2 are input to the gates of the transistors 901 and 903, respectively. The gates of the transistors 902 and 904 are connected in common to feedback an output Vn1 of the differential amplifier. The output pairs of the first and second differential pairs are connected to the input terminal and the output terminal of the current mirror (905, 906), respectively, and performs an amplification operation according to an output signal common to the first and second differential pairs.

In the differential amplifier having the above-mentioned configuration,

- when the voltages Vp1 and Vp2 are the same input voltages, the output voltage Vn1 becomes equal to the input voltages, and
- when the voltages Vp1 and Vp2 are different, the output voltage Vn1 becomes the voltage intermediate between the voltages Vp1 and Vp2.

In the hereinafter-described patent document 3, a configuration including a string DAC (digital-to-analog converter) and an interpolation DAC is disclosed. The interpolation DAC includes a plurality of differential pairs. Ones of the input pairs of the differential pairs are connected to the output of the string DAC through respective switches. The others of the input pairs of the differential pairs are connected in common to an output terminal. Ones and the others of the output pairs of the differential pairs are connected in common to pairs of load devices and also connected to differential input pairs in an amplification stage. The output of the amplification stage is connected to an output terminal.

[Patent Document 1]

Japanese Patent Kokai Publication No. JP-P2001-34234A (FIG. 5, FIG. 20, FIG. 21).

[Patent Document 2]

Japanese Patent Kokai Publication No. JP-P2001-343948A (FIG. 15).

[Patent Document 3]

U.S. Pat. No. 6,246,351 (FIG. 1).

SUMMARY OF THE DISCLOSURE

It is pointed out that the differential amplifier shown in FIG. 32 has a (first) problem that when the voltage intermediate between the two input voltages is output and a voltage difference between the two input values is large, the output voltage does not become intermediate, and is shifted to one of the two input voltages (refer to a description in a column [0113] on page 13 in patent document 1 described above).

The output voltage characteristic of the data driver in the liquid crystal display device is as shown in FIG. 33 (corresponding to FIG. 20(*b*) in patent document 1 described before). In the intermediate portion of grayscale data, though a potential difference between grayscales is small, potential differences in the lower and upper sides of the grayscale data are large.

Accordingly, when the differential amplifier in FIG. 32 is used for the output buffer circuit of the data driver in the liquid crystal display device, there is a (second) problem that the differential amplifier can only be applied to the intermediate portion of the grayscale data.

For this reason, the configuration as shown in FIG. 34 (corresponding to FIG. 21 in patent document 1 described before) is displayed in patent document 1 described before, as the data driver of the liquid crystal display device.

The data driver shown in FIG. 34 differs from the data driver shown in FIG. 31 in the configuration of the grayscale voltage generating circuit. In the configuration of the grayscale voltage generating circuit shown in FIG. 34, as the grayscale voltages corresponding to the lower and upper sides of the grayscale data, grayscale voltages (V0, V1, V2 . . . , Vk, and Vn, V(n+1) . . . , V(m−1) are generated for each grayscale, and as the grayscale voltages corresponding to intermediate grayscale data, grayscale voltages (Vk, V(k+2), V(k+4), . . . , Vn) are generated for each two grayscales.

Accordingly, when the differential amplifier shown in FIG. 32 is employed in the output buffer circuit 988 of the data driver in the liquid crystal device shown in FIG. 31, a proportion capable of reducing the number of data lines is reduced. For this reason, there is a (third) problem that the effect of reducing the circuit size of the decoders 987 and reducing the area of the data driver LSI is reduced.

Since the inventor of the present invention has investigated the characteristics of the differential amplifier in FIG. 32 disclosed in the patent document 1 described before and the like and studied about the problem of the differential amplifier in FIG. 32, a description will be given below.

FIG. 35 is a graph for explaining an operation when the differential amplifier in FIG. 32 outputs the voltage Vn1 intermediate between the input voltages Vp1 and Vp2. A description will be given below with reference to FIG. 35.

Respective transistors in the two differential pairs (901, 902) and (903, 904) of the differential amplifier in FIG. 32 are assumed to have the same size, and currents that flow through the transistors 901, 902, 903, and 904 are indicated by Ia, Ib, Ic, and Id, respectively. FIG. 35 shows the case where the input voltage Vp1 is smaller than the input voltage Vp2. FIG. 35 is a graph showing the relationship between a drain-to-source current Ids (on a vertical axis) and a voltage V (horizontal axis) with respect to a power supply VSS, and shows a characteristic curve (Ids-Vg characteristic) of the transistors 901 to 904. When this graph is used, the operation of this amplifier is comparatively easy to understand.

Since the sources of the two differential pairs are connected in common and the sizes of the transistors are the same, the respective transistors in the two differential pairs have operating points on the common characteristic curve shown in FIG. 35.

Further, currents that flow through the input terminal and the output terminal of the current mirror (905, 906) are equal to each other, so that the currents that flow through the respective transistors in the two differential pairs satisfy the relationship in the following equation (1).

$$Ia+Ic=Ib+Id \quad (1)$$

Further, since the gates, sources, drains of the transistors 902 and 904 are common, respectively, the following equation (2) holds.

$$Ib=Id \quad (2)$$

From the above two relations, it can be seen that Ib and Id has a magnitude that divides Ia and Ic by two and a voltage corresponding to it becomes Vn1.

The characteristic curve of the transistors is a two-dimensional curve. Thus, as seen from FIG. 35, when a voltage difference between the voltages Vp1 and Vp2 is small, the characteristic curve can be linearly approximated. Accordingly, the voltage Vn1 becomes the voltage (intermediate voltage) that divides Vp1 and Vp2 by two.

However, as a voltage difference between the voltages Vp1 and Vp2 increases, Vn1 shifts to the voltage Vp2 at the higher potential side.

In order to confirm it specifically, the result of simulation by the differential amplifier in FIG. 32 (made by the inventor of the present invention) will be shown in FIG. 36. FIG. 36 shows the output characteristic of the output voltage Vn1 when the input voltage Vp1 is fixed and Vp2 is changed with respect to Vp1 in the range of +0.5V. A broken line in the figure indicates an output expectation value that divides the voltages Vp1 and Vp2 by two.

From FIG. 36, it can be seen that the voltage Vn1 is comparatively close to the output expectation value when Vp2 with respect to Vp1 is in the range of ±0.1V. It can be seen that when Vp2 with respect to Vp1 is in the range of ±0.5 V, the voltage Vn1 is greatly deviated from the output expectation value and is shifted to the higher potential side between the two input voltages Vp1 and Vp2.

Accordingly, it can be seen that in the differential amplifier shown in FIG. 32, there is a problem that output of the voltage intermediate between the two input voltages is only possible when a potential difference between the two input voltages is extremely small.

Next, the decoders 987 shown in FIG. 31 will be analyzed in detail. The grayscale voltage generating circuit 986 for the data driver, shown in FIG. 31 generates grayscale voltages for each two grayscales, and reduces the number of grayscale voltage lines of the decoders 987 to approximately a half of the number of grayscale power supply lines of the decoders 984 in FIG. 30. However, the number of the transistors that constitute the decoders is not greatly reduced. Thus, it can be seen that there is also the problem that the effect of area saving is low (according to the result of study by the inventor of the present invention). This problem in the case of the decoders 987 for 4-bit data input will be described with reference to FIGS. 37 and 38.

FIG. 37 is a table showing input and output correspondence relationship between the decoder 987 and the buffer circuit 988 in FIG. 31. In FIG. 37, nine grayscale voltages A to I for each two grayscales are provided for 17 output levels, and a combination of two grayscale voltages selected by the decoder 987 is shown in the row of (Vp1, Vp2).

Since an input voltage (grayscale voltage) A is output from the buffer circuit 988 as a first level, for example, the decoder 987 selects (A, A) as the two voltages (Vp1, Vp2) input to the buffer circuit 988.

Further, as a second level, a voltage intermediate between the input voltage A at the first level and the input voltage B at the third level (grayscale voltages) is output from the buffer circuit 988. Thus, the decoder 987 selects (A and B) as the two voltages (Vp1 and Vp2) input to the buffer circuit 988.

Likewise, combinations of (Vp1 and Vp2) corresponding to 17 levels are determined.

Then, in FIG. 37, one to 16 levels are associated with four-bit data (D3, D2, D1 and D0).

As described above, in the method disclosed in patent document 1 described before, in which two grayscale voltages are selectively input and one of the two grayscale voltages and the intermediate voltage therebetween are output, the number of the levels of output levels plus one is necessary. As the number of input voltages (grayscale voltages), a half of the number of the output levels plus one is necessary.

FIG. 38 is a diagram showing a specific example of a configuration of the decoder 987 using n-channel transistors, for selecting a combination of (Vp1 and Vp2) in FIG. 37. Gray scale voltages selected from the nine input voltages (grayscale voltages) A to I are output to the output lines (for Vp1, Vp2) using four-bit data signals (D3, D2, D1 and D0) and their inverted signals (D3B, D2B, D1B and D0B). The decoder configured to have p-channel transistors can be easily implemented by a configuration in which the data signal indicating each bit and its inverted signal are exchanged.

In the example of the decoder shown in FIG. 38, the configuration in which bit lines (D1 and D1B) are added to have high-order three bits (D3, D2 and D1) and low-order two bits (D1 and D0). The configuration of the high-order bits (D3, D2 and D1) is configured to have the minimum number of transistors as a tournament type. The decoder in FIG. 38 is configured to select two grayscale voltages by the high-order three bits (D3, D2 and D1) and select the grayscale voltages output to the output lines (Vp1 and Vp2), respectively by the low-order two bits. The four-bit decoder in FIG. 38 in this case is constituted from nine input voltages (grayscale voltages), 10 bit lines, and 30 transistors (transistors 401 to 430). The four-bit decoder can also be configured to be separated into respective units for high-order two bits (D3 and D2) and the low-order two bits (D1 and D0). The four-bit decoder, for example, becomes the configuration in which three grayscale voltages are selected by the high-order two bits (D3 and D2) and grayscale voltages output to the output lines (Vp1 and Vp2) respectively are selected from the three grayscale voltages by the low-order two bits (D1 and D0). In this case, the number of grayscale voltage lines will be added.

For comparison with the decoder 987 in FIG. 38, a configuration of the decoder 984 in FIG. 30 (constituting n-channel transistors) will be shown in FIG. 39.

The configuration shown in FIG. 39 is of the tournament type in which the number of transistors is minimized and is constituted from 16 input voltages (grayscale voltages), 8 bit lines, and 30 transistors (transistors 501 to 530).

When the configurations of the decoders shown in FIGS. 38 and 39, respectively, are compared, it can be seen that even if the number of input voltages (grayscale voltages) is reduced to about a half, the number of transistors in the configuration shown in FIG. 38 remains the same. Though being more or less different depending on the number of bits and the configuration of the decoder, the decoder 987 in FIG. 31 disclosed in patent document 1 described before, has the problem that the number of transistors constituting the decoder is not greatly reduced in general, and the effect of area saving is low.

In order to cope with the above-mentioned problems, preferably, the differential amplifier used in the output buffer circuit 988 can output three or more multi-levels of voltage for two input voltages and can output respective output levels over a wide voltage range with high precision.

Accordingly, it is an object of the present invention to provide a differential amplifier in which a maximum of four voltage levels can be output for two input voltages and the respective output levels over the wide voltage range can be output with high precision.

Another object of the present invention is to provide a data driver in which the number of input voltages (grayscale voltages) is greatly reduced and the number of transistors is also reduced.

Still other object of the present invention is to provide a data driver and a display device including the data driver that achieve area saving and low cost.

The above and other objects are attained by a differential amplifier according to one aspect of the present invention, including at least one differential pair having one of the input pair thereof connected to an input terminal and the other of the input pair thereof feedback connected to an output terminal; another input terminal; and another differential pair having an output pair thereof connected in common to the output pair of said one differential pair, one of an input pair thereof connected to the input terminal, and the other connected to the another input terminal.

More specifically, a differential amplifier according to one aspect of the present invention includes at least:

first and second input terminals;

an output terminal;

a first differential pair with one of an input pair thereof connected to the first input terminal and the other connected to the output terminal;

a second differential pair with one of an input pair thereof connected to the first input terminal and the other connected to the second input terminal;

a first current source for supplying current to the first differential pair;

a second current source for supplying current to the second differential pair; and a load circuit connected to output pairs of the first and second differential pairs;

wherein at least one of the output pair of the first differential pair is connected in common to one of the output pair of the second differential pair; and an amplification stage is included, an input terminal thereof being connected to a common connection node between the one of the output pair of the first differential pair and the one of the output pair of the second differential pair and an output terminal thereof being connected to the output terminal.

In the present invention, the other of the output pair of the first differential pair is connected in common to the other of the output pair of the second differential pair, and the load circuit is connected to the common connection node between the one of the output pair of the first differential pair and the one of the output pair of the second differential pair and a common connection node between the other of the output pair of the first differential pair and the other of the output pair of the second differential pair, and includes a pair of load devices constituting a common load of the first and second differential pairs.

In the present invention, the load circuit includes: a first pair of load devices connected to the output pair of the first differential pair; and a second pair of load devices connected to the output pair of the second differential pair.

The present invention may include: first changeover switches for switching connection between the first input terminal and first and second input voltages; and second changeover switches for switching connection between the second input terminal and the first and second input voltages;

wherein when one of the first and second input terminals is connected to one of the first and second input voltages, the other of the first and second input terminals may be connected to either the one or the other of the first and second input voltages.

The present invention may include a current control circuit for adjustably controlling current of the first current source and current of the second current source.

In the present invention, the amplification stage may at least include a transistor connected between a first power supply and the output terminal, a control terminal thereof being connected to the output terminal of the differential stage, and may include a charging circuit or a discharging circuit connected between the output terminal and a second power supply.

The present invention may include a changeover switch for switching connection of an input of the input pair of the second differential pair different from the input connected to the first input terminal to either of the output terminal or the second input terminal.

In the present invention, the changeover switch may connect the input of the input pair of the second differential pair different from the input connected to the first input terminal to the output terminal for a predetermined period, and then may switch connection of the input of the input pair of the second differential pair to the second input terminal.

An amplifier according to the present invention increases at least:

first and second input terminals for receiving first and second signals, respectively; and an output terminal;

wherein an output signal at a level obtained by externally dividing a level of the first signal input to the first input terminal and a level of the second signal input to the second input terminal by a predetermined extrapolation ratio is output from the output terminal. In this amplifier, when the first signal input to the first input terminal is lower than the second signal input to the second input terminal, the output signal calculated such that a ratio of a difference between the levels of the first signal and the output signal to a difference between the levels of the second signal and the output signal becomes a predetermined value is output from the output terminal, and when the first signal input to the first input terminal is higher than the second signal input to the second input terminal, the output signal calculated such that the ratio of the difference between the levels of the first signal and the output signal to the difference between the levels of the output signal and the second signal becomes a predetermined value is output from the output terminal.

A data driver for a display device according to another aspect of the present invention includes:

a grayscale voltage generating circuit for generating a plurality of voltage levels;

a decoder for outputting at least two voltages selected from among the plurality of voltage levels, based on input data; and a buffer circuit for inputting the two voltages output from the decoder and outputting a voltage corresponding to the input data from an output terminal thereof; wherein the buffer circuit is constituted from the differential amplifier according to the present invention, described above.

A display device according to still another aspect of the present invention includes:

a plurality of data lines extended in parallel to each other in one direction;

a plurality of scanning lines extended in parallel to each other in a direction orthogonal to the one direction; and a plurality of pixel electrodes disposed at intersections between the plurality of data lines and the plurality of scanning lines in a matrix form;

a plurality of transistors corresponding to the plurality of pixel electrodes, ones of drains and sources of the plurality of transistors being connected to the corresponding pixel electrodes and the others of the drains and the sources being connected to the corresponding data lines, gates of the plurality of transistors being connected to the corresponding scanning lines; and a gate driver for supplying a scanning signal to each of the plurality of scanning lines.

As a data driver for supplying a grayscale signal corresponding to input data to each of the plurality of data lines, the data driver for a display device according to the present invention is included.

In the data driver according to the present invention, the grayscale voltage generating circuit may output 2×s grayscale voltages of a (4×k−2)th grayscale voltage and a (4×k−1)th grayscale voltage among 4×s grayscale voltages, wherein s indicates a predetermined positive integer and k indicates one of integers from one to s.

The data driver according to the present invention may include: a first selection unit for selecting two grayscale voltages of a (4×j−2)th grayscale voltage and a (4×j−1)th grayscale voltage out of the 2×s grayscale voltages output from the grayscale voltage generating circuit according to the input data signal constituted by high-order (n−2) bits among an input data signal having n bit width, wherein n indicates a positive integer exceeding two and j indicates one of the integers from one to s; and a second selection unit for selecting between the two grayscale voltages selected by the first selection unit the voltages to be supplied to first and second terminals of the buffer circuit according to the input data signal constituted by low-order two bits among the input data signal having n-bit width.

The meritorious effects of the present invention are summarized as follows.

According to the present invention, in a differential amplifier that receives two input voltages and can output a total of four levels including the two input voltages and their extrapolation voltages, the four voltage levels can be output over a wide voltage range with high precision.

According to the present invention, a decoder that outputs two input voltages to be selectively input to the two input terminals of the differential amplifier can greatly reduce the number of input voltages (grayscale voltages), also can greatly reduce the number of transistors, and can implement area saving.

According to the present invention, by employing the differential amplifier and decoder described above, a data driver LSI that achieves area saving and low cost becomes possible. Alternatively, cost reduction and the narrower frame of a display device including the data driver also become possible.

Still other objects and advantages of the present invention will become readily apparent to those skilled in this art from the following detailed description in conjunction with the accompanying drawings wherein only the preferred embodiments of the invention are shown and described, simply by way of illustration of the best mode contemplated of carrying out this invention. As will be realized, the invention is capable of other and different embodiments, and its several details are capable of modifications in various obvious respects, all without departing from the invention. Accordingly, the drawing and description are to be regarded as illustrative in nature, and not as restrictive.

BRIEF DESCRIPTION OF THE DRAWINGS

FIG. 20 is a table showing correspondences between input data and output levels in a two-bit data input DAC according to an eighth embodiment of the present invention;

FIG. 23 is a table showing correspondences between input data and output levels in a four-bit data input DAC according to a ninth embodiment of the present invention in the form of the table;

FIG. 37 is a table showing input and output correspondences of a decoder 987 and a buffer circuit 988 in FIG. 31;

PREFERRED EMBODIMENTS OF THE INVENTION

Figure 1:
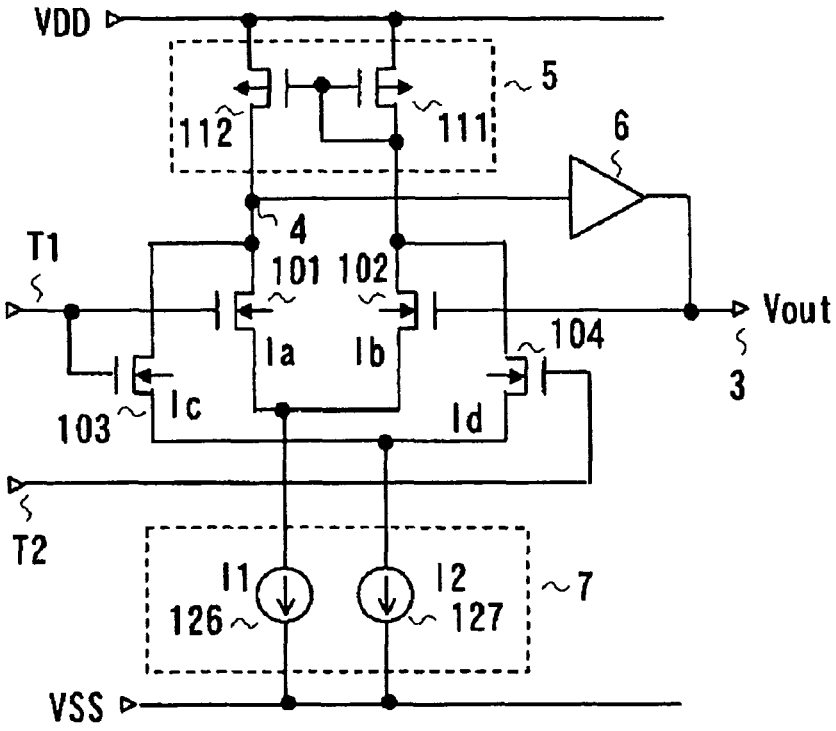
FIG. 1 is a diagram showing a configuration of a differential amplifier according to a first embodiment of the present invention.

Best modes for carrying out the present invention will be described. A differential amplifier, according to one embodiment mode of the present invention, having a first differential pair (101, 102) with one (non-inverting input side) of the input pair of the first differential pair (101, 102) connected to a first input terminal (T1) and the other (inverting input side) feedback connected to an output terminal (3), includes a second differential pair (103, 104) with an output pair thereof connected in common to the output pair of the first differential pair (101, 102), one of an input pair thereof connected to the first input terminal (T1), and the other connected to a second input terminal (T2) different from the first input terminal (T1).

This embodiment mode includes a first current source (126) for supplying current to the first differential pair (101, 102), a second current source (127) for supplying current to the second differential pair (103, 104), and a load circuit (111, 112) connected to output pairs of the first and second differential pairs. One of the output pair of the first differential pair (101, 102) is connected in common to one of the output pair of the second differential pair (103, 104), and the common connection node constitutes an output terminal (4) of the differential stage.

In this embodiment mode, the other of the output pair of the first differential pair (101, 102) is connected in common to the other of the output pair of the second differential pair (103, 104), and the load circuit (111, 112) is connected to the common connection node between the one of the output pair of the first differential pair and the one of the output pair of the second differential pair, and the common connection node between the other of the output pair of the first differential pair and the other of the output pair of the second differential pair, and constitutes a load common to the first and second differential pairs.

In an embodiment mode of the present invention, the load circuit includes a first load circuit (113, 114) connected to the output pair of the first differential pair (101, 102) and a second load circuit (115, 116) connected to the output pair of the second differential pair (103, 104).

An embodiment mode of the present invention includes first changeover switches (151, 154) for switching connection between a first input voltage (Vi1) and a second input voltage (Vi2) to the first input terminal (T1) and second changeover switches (152, 155) for switching connection between the first and second input voltages (Vi1, Vi2) to the second input terminal (T2). When one of the first and second input terminals (T1, T2) is connected to one of the first and second input voltages, the other of the first and second input terminals (T1, T2) is connected to one or the other of the first and second input voltages.

An embodiment mode of the present invention includes a current control circuit (7), whereby bias voltages to a transistor constituting the first current source (126) and a transistor constituting the second current source (127) are set to be adjustable, respectively.

In an embodiment mode of the present invention, the amplification stage (6) includes a transistor (109) inserted between a first power supply (VDD) and the output terminal (3), having a control terminal thereof connected to the output terminal (4) of the differential stage and a current source (110) connected between the output terminal (3) and a second power supply (VSS).

An embodiment mode of the present invention includes the first and second input terminals (T1, T2), output terminal (3), a first differential stage connected to the first and second input terminals, a second differential stage connected to the first and second input terminals, first amplification stage (6) with an input terminal thereof connected to the output terminal of the first differential stage and an output terminal thereof connected to the output terminal (3), and a second amplification stage (16) with an input terminal thereof connected to the output terminal of the second differential stage and an output terminal thereof connected to the output terminal (3). In this embodiment mode, the first differential stage includes the first differential pair (101, 102) of a first conductivity type, with one of an input pair thereof connected to the first input terminal (T1) and the other connected to the output terminal (3), second differential pair (103, 104) of the first conductivity type, with one of an input pair thereof connected to the first input terminal (T1) and the other connected to the second input terminal (T2), first current source (126) for supplying current to the first differential pair (101, 102), second current source (127) for supplying current to the second differential pair (103, 104), and first load circuit (5) connected to the output pairs of the first and second differential pairs. Then, one of the output pair of the first differential pair and one of the output pair of the second differential pair are connected in common, and the common connection node of them constitutes the output terminal (4) of the first differential stage. The second differential stage includes a third differential pair (201, 202) of a second conductivity type with one of an input pair thereof connected to the first input terminal (T1) and the other connected to the output terminal (3), a fourth differential pair (203, 204) of the second conductivity type with one of an input pair thereof connected to the first input terminal (T1) and the other connected to the second input terminal (T2), a third current source (226) for supplying current to the third differential pair, a fourth current source (227) for supplying current to the fourth differential pair, and a second load circuit (15) connected to the output pairs of the third and fourth differential pairs. One of the output pair of the third differential pair and one of the output pair of the fourth differential pair are connected in common, and the common connection node of them constitutes the output terminal (14) of the second differential stage.

In an embodiment mode of the present invention, changeover switches for switching connection of the other of the input pair of the second differential pair different from one of the input pair connected to the first input terminal to either of the output terminal and the second input terminal may be provided.

In the embodiment mode of the present invention, switching is performed so that the other of the input pair of the second differential pair is connected to the second input terminal after connected to the output terminal for a predetermined period.

The differential amplifier according to the embodiment mode of the present invention includes the first and second input terminals (T1, T2) for receiving first and second signals, respectively, and the output terminal (3). An output signal of a voltage obtained by externally dividing a first signal voltage V(T1) input to the first input terminal (T1) and a second signal voltage V(T2) input to the second input terminal (T2) by a predetermined extrapolation ratio is output from the output terminal (3).

When the first signal voltage V(T1) input to the first input terminal is lower than the second signal voltage (VT2) input to the second input terminal in this differential amplifier, (or when V(T1)<V(T2)), an output voltage calculated such that the ratio of a potential difference (V(T1)−Vout) between the first signal voltage V(T1) and a voltage Vout of the output signal to a potential difference (V(T2)−Vout) between the second signal voltage V(T2) and the voltage Vout of the output signal becomes a predetermined value is output. When the first signal voltage V(T1) input to the first input terminal is larger than the second signal voltage V(T2) input to the second input terminal, (or when V(T1)>V(T2)), an output voltage calculated such that the ratio of a potential difference (Vout−V(T1)) between the output voltage Vout and the first signal voltage V(T1) to a potential difference (Vout−V(T2)) between the output voltage Vout and the second signal voltage V(T2) becomes a predetermined value is output from the output terminal (3).

In the differential amplifier according to the embodiment mode of the present invention, when the extrapolation ratio is set to one to two and the signal voltages input to the first and second input terminals (T1, T2) are at second and third levels, respectively, the voltage at a first level obtained by extrapolating the second and third levels at the ratio of one to two is output. When the signal voltages input to the first and second input terminals are both at the second level, the voltage at the second level is output. When the signal voltages input to the first and second input terminals are both at the third level, the voltage at the third level is output. When the signal voltages input to the first and second input terminals are at the third and second levels, respectively, the voltage at a fourth level obtained by extrapolating the third and second levels at the ratio of one to two is output. In the differential amplifier according to the embodiment mode of the present invention, the difference voltage between the first through fourth levels is set to be the same.

In the differential amplifier according to the present invention, the number of the differential pairs is not limited to two. The differential amplifier, for example, includes first through {2×(m−1}th input terminals, one output terminal, and first through mth differential pairs (101, 102; 103, 104; 105, 106), in which m is a predetermined positive integer exceeding two. One of the input pair of the first differential pair is connected to the first input terminal, and the other is connected to the output terminal. One of the input pair of the second differential pair is connected to the first input terminal, and the other is connected to the second input terminal. The input pair of the ith differential pair is connected to the {2×(i−1)−1} th input terminal and the {2×(i−1)}th input terminal, respectively, (in which i is an integer two or more but not exceeding m). When i is three, for example, the input pair of the third differential pair is connected to the third input terminal (T3) and the fourth input terminal (T4). The differential amplifier may include first through mth current sources (126, 127, 128) for supplying currents to the first through mth differential pairs, load circuit (5) connected to common connection nodes for ones of the output pairs of the first through mth differential pairs and common connection nodes for the others of the output pairs of the first through mth differential pairs, and amplification stage (6) having an input pair thereof connected to the common connection nodes between the ones of the output pairs of the first through mth differential pairs and the common connection nodes between the others of the output pairs of the first through mth differential pairs, and an output terminal thereof connected to the output terminal.

As described above, when the differential amplifier is configured to have three or more differential pairs, the extrapolation ratio set for the first and second differential pairs is modulated according to input voltages input to the input pair of the ith differential pair.

The present invention will be described in detail with reference to drawings. FIG. 1 is a diagram showing a configuration according to an embodiment of the present invention. A differential amplifier according to the present embodiment is the differential amplifier that can output an extrapolation voltage extrapolated from voltages supplied to input terminals T1 and T2. The differential amplifier in FIG. 1 includes a first differential pair and a second differential pair. The first differential pair is constituted from n-channel transistors 101 and 102 having their sources connected in common and driven by a first current source 126. The second differential pair is constituted from n-channel transistors 103 and 104 having their sources connected in common and driven by a second current source 127. The gate of one transistor 101 constituting the first differential pair (on the non-inverting input side of a pair of inputs of the first differential pair) is connected to the input terminal T1, while the gate of the other transistor 102 (on the inverting input side of the pair of inputs of the first differential pair) is connected to an output terminal 3. The gate of one transistor 103 constituting the second differential pair is connected to the input terminal T1, while the gate of the other transistor 104 is connected to an input terminal T2.

In the present embodiment, pairs of outputs of the first and second differential pairs are connected in common. That is, the drain of the transistor 101 constituting the first differential pair is connected in common to the drain of the transistor 103 constituting the second differential pair and the drain of the transistor 102 constituting the first differential pair is connected in common to the drain of the 104 constituting the second differential pair with respective common connection nodes being connected respectively to an output terminal and an input terminal of a current mirror circuit 5 constituted from p-channel transistors 111 and 112 (the drain of the p-channel transistor 112 and the drain of the p-channel transistor 111). Hereinafter, a differential pair constituted from the transistors 101 and 102 is also indicated by the differential pair (101, 102), while the current mirror circuit constituted from the transistors 111 and 112 is also indicated by the current mirror circuit (111, 112).

An amplification stage 6, which is connected between an output terminal 4 of the current mirror circuit 5 (the drain of the transistor 112) and the output terminal 3, receives the output signal of the current mirror circuit 5 to perform an amplification operation. The configuration shown in FIG. 1 is the differential amplifier in which the output terminal is feedback connected to the first differential pair (101, 102). The current mirror circuit 5 may have an arbitrary configuration, and may have the configuration in which two cascode stages are stacked, for example.

The amplification stage 6 may have an arbitrary configuration which receives the output signal of the current mirror circuit 5 and carry out an amplification operation to supply an output to the output terminal 3. It is assumed that a constant current does not flow between the output terminal 4 of the current mirror circuit 5 (the drain of the transistor 112) and the amplification stage 6.

When two input voltages are selectively input to the input terminals (T1 and T2), the differential amplifier in FIG. 1 can output a total of four voltages constituted from voltages equal to the two input voltages and the voltages extrapolated from the two input voltages.

Figure 2:
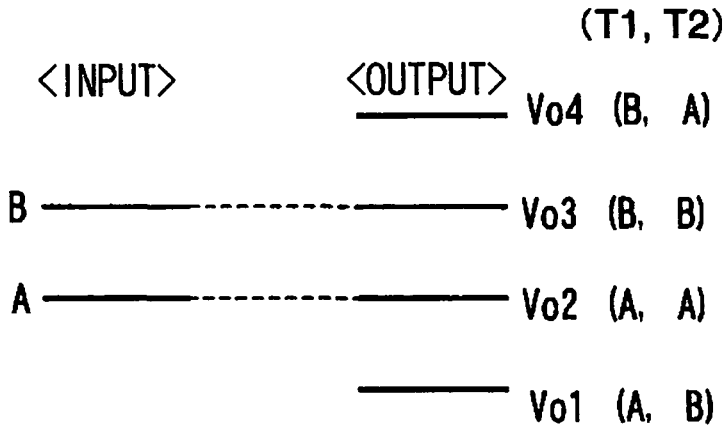
FIG. 2 is a graph explaining an extrapolating operation of the differential amplifier in the first embodiment of the present invention.

FIG. 2 is a diagram showing correspondence between its input and output levels. Referring to FIG. 2, for two input voltages (A, B), four voltage levels of Vo1 to Vo4 can be output.

Voltages supplied to input terminals (T1 and T2) are indicated by V(T1) and V(T2) respectively. When V(T1) is different from V(T2), or ((V(T1), V(T2))=(A, B) or (B,A)), the output of the differential amplifier in FIG. 1 becomes the extrapolation voltage (Vo1 or Vo4) extrapolated from the input voltages (A, B).

When V(T1) is equal to V(T2), or ((V(T1), V(T2))=(A, A) or (B, B)), an output voltage Vout of the differential amplifier in FIG. 1 becomes the voltage equal to the input voltage (Vo2 or Vo3).

Next, operations of the differential amplifier in FIG. 1 will be described with reference to FIGS. 3 and 4. For description of the operations in FIGS. 3 and 4, the transistors 101 to 104 in FIG. 1 are assumed to have the same size (having the same characteristics) and it is also assumed that currents I1 and I2 flown through two current sources 126 and 127 are set to be equal.

Figure 3:
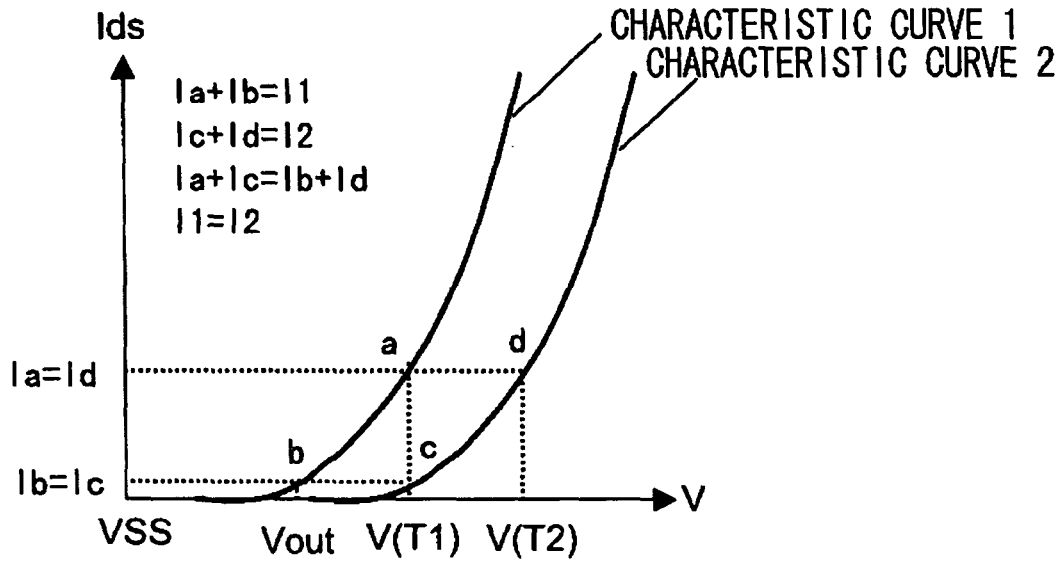
FIG. 3 is a graph explaining the extrapolating operation of the differential amplifier in the first embodiment of the present invention using its current-voltage characteristics.
Figure 4:
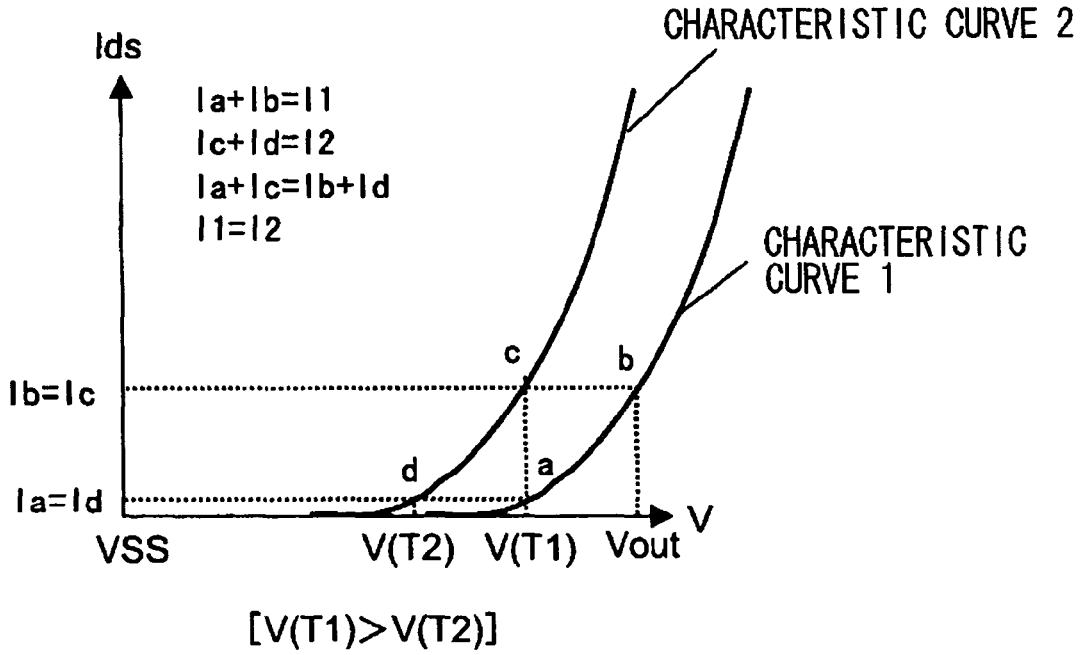
FIG. 4 is a graph explaining the extrapolating operation of the differential amplifier in the first embodiment of the present invention using its current-voltage characteristics.

FIGS. 3 and 4 are graphs explaining the cases where V(T1) is smaller than V(T2), and V(T1) is larger than V(T2). FIGS. 3 and 4 respectively indicate a characteristic curve 1 of the transistors 101 and 102 and a characteristic curve 2 of the transistors 103 and 104 in the graph showing the relationship between a drain-to-source current Ids and a voltage V (voltage with respect to VSS), indicating V-I characteristics. The operating points of the respective transistors exist on the respective characteristic curves. The respective source potentials of the two differential pairs change separately. The two characteristic curves are thereby simply shifted in a horizontal direction. Use of such graphs facilitates understanding of the operation principle of the circuit.

When currents corresponding to the operation points a, b, c and d of the transistors 101, 102, 103, and 104 are indicated by Ia, Ib, Ic, and Id, respectively, the currents that flow through the respective transistors are indicated by Ia, Ib, Ic, and Id. In regard to the relationship between the currents of the respective transistors in the configuration in FIG. 1 with respect to the two differential pairs, the following Equations (3) and (4) hold:

$$Ia+Ib=I1 \tag{3}$$

$$Ic+Id=I2 \tag{4}$$

Since the currents that flow through the input and output pairs of the current mirror of the load circuit 5 are equal, the relationship in the following Equation (5) holds.

$$Ia+Ic=Ib+Id \tag{5}$$

Further, it is assumed that the output terminal of the current mirror circuit constituting the load circuit 5 (the drain of the transistor 112) supplies only a voltage signal to the amplification stage 6, and that a constant current does not flow between the output terminal and the amplification stage 6.

Further, the current I1 for the current source 126 and the current I2 for the current source 127 are set to be:

$$I1=I2 \tag{6}$$

When the above relations are solved, the following Equation (7) can be obtained.

$$Ia=Id,\ Ib=Ic \tag{7}$$

At this point, referring to FIG. 3, the output voltage Vout of the differential amplifier in FIG. 1 becomes the voltage in which the voltages V(T1) and V(T2) are divided externally toward a low potential side at a ratio of one to two (1:2). Referring to FIG. 4, the output voltage Vout becomes the voltage in which the voltages V(T1) and V(T2) are divided externally toward a high potential side at the ratio of one to two (1:2).

The extrapolation (external division) ratio is defined to be the ratio of an absolute value |Vout−V(T1)| to an absolute value |Vout−V(T2)|. The reason in regard to the external division ratio (interpolation ratio) is explained as follows:

The operating points a and c of the transistors 101 and 103 have the common voltage V(T1) with respect to the horizontal axis in FIGS. 3 and 4. Accordingly, a figure connecting four operating points on the characteristic curves on the transistors 101 to 104 becomes a parallelogram. Since a side ad is equal to a side bc in the parallelogram, the output voltage Vout becomes the extrapolation (external division) voltage extrapolated from the voltages V(T1) and V(t2). Then, the voltage intermediate between the output voltage Vout and the voltage V(T2) becomes the voltage V(T1).

$$V(T1)=(V\text{out}+V(T2))/2 \tag{8}$$

More specifically, referring to FIGS. 3 and 4, the output voltage Vout becomes the extrapolation (external division) voltage defined by the following Equation (9).

$$V\text{out}=V(T1)+\{V(T1)-V(T2)\} \tag{9}$$

If the respective transistors (101, 102, 103, and 104) of the two differential pairs have comparatively the same size (having the same characteristics) under the conditions defined in Equations (3) to (6), such an extrapolation (external division) operation holds irrespective of the absolute value of the size.

On the other hand, as to a voltage difference between the voltages V(T1) and V(T2) supplied to the input terminals T1 and T2, the extrapolation operation also holds over a predetermined range, irrespective of the voltage difference between V(T1) and V(T2). However, there is an upper limit to this voltage difference range. The possible range of the voltage difference between the voltages V(T1) and V(T2) will be described below.

As clear from FIGS. 3 and 4, when the voltages V(T1) and V(t2) are different, the currents that flow through the respective pair transistors (101, 102) and (103, 104) of the two differential pairs are different. When the voltage difference between V(T1) and V(T2) increases, a difference between the currents that flow through the same pair (differential pair) also increases. However, the sum of the currents that flow through the same pairs in the first differential pair (101, 102) and the second differential pair (103, 104) are defined by the constant currents I1 and I2, respectively. If the voltage difference between the V(T1) and V(T2) further expands, ones of the pair transistors in the differential pairs (the transistors 102 and 103 at the operating points b and c in FIG. 3 and the transistors 101 and 104 at the operating points a and d in FIG. 4) become an off state in which no current flows.

As a result, the relations of the currents at the respective operating points described above do not hold, so that the differential amplifier in FIG. 1 cannot output a precise extrapolation voltage. In this manner, the range of the voltage difference between the voltages V(T1) and V(T2) has an upper limit which depends on settings of the characteristic curves of the transistors 101, 102, 103, and 104 and the currents I1 and I2.

Next, the case where V(T1)=V(T2) will be described. When V(T1)=V(T2), the voltages supplied to the input pair of the differential pair (103, 104) are equal in the differential amplifier in FIG. 1. The voltages supplied to the input pair of the differential pair (101, 102) are V(T1) and Vout. Due to the operation of the differential pair (101, 102), Vout=V(T1) holds, so that Vout becomes stable. Accordingly, when V(T1)=V(T2), the output voltage Vout of the differential amplifier in FIG. 1 becomes equal to the input voltage V(T1).

As described above, the differential amplifier in FIG. 1 selectively inputs the two input voltages to the terminals T1 and T2, as shown in FIG. 2, thereby allowing output of the two input voltages and the voltages extrapolated from the voltages (or obtained by external division of the voltages).

Then, referring to FIG. 1, when the transistors 101 to 104 are set to have the same size and the currents I1 and I2 flown through the two current sources are also set to be equal, the extrapolation (externally divided) voltages become the voltages obtained by external division of the voltages V(T1) and V(T2) input to the terminals T1 and T2 at the ratio of one to two.

Figure 5:
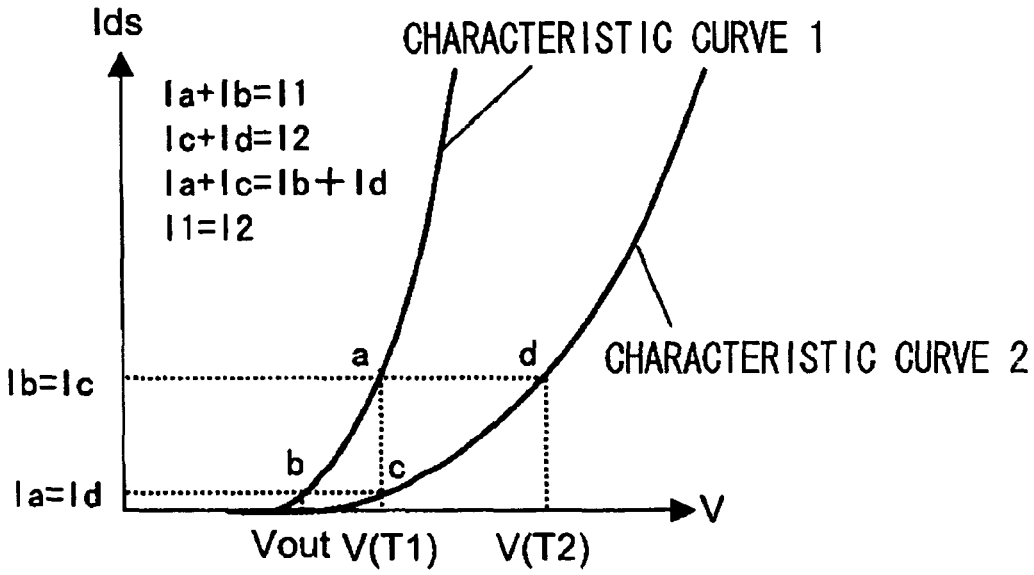
FIG. 5 is a graph explaining the extrapolating operation of the differential amplifier in the first embodiment of the present invention using its current-voltage characteristics.
Figure 6:
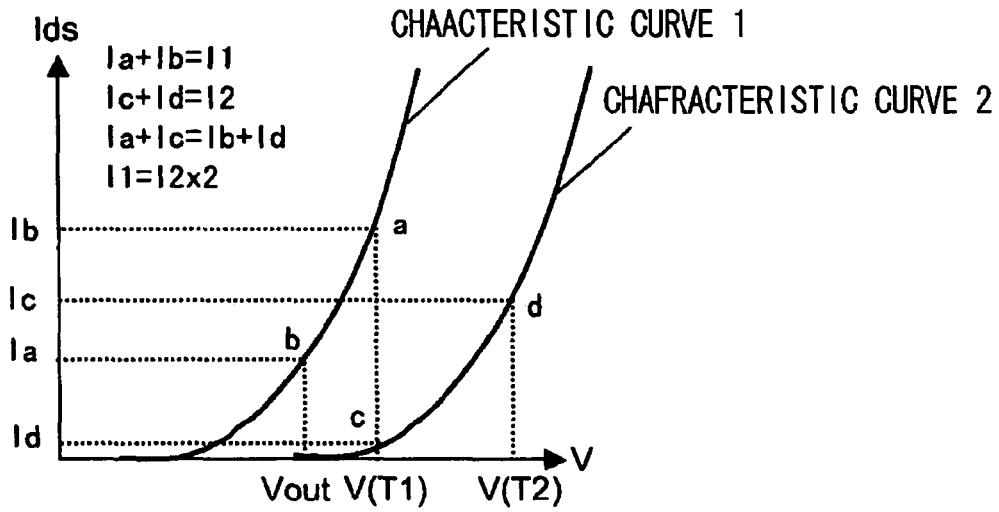
FIG. 6 is a graph explaining the extrapolating operation of the differential amplifier in the first embodiment of the present invention using its current-voltage characteristics.

In examples shown in FIGS. 3 and 4, a description was directed to the case where the extrapolation (externally divided) output voltages of the differential amplifier in FIG. 1 becomes the voltages obtained by external division of the voltage V(T1) and the voltage V(T2) at the ratio of one to two. The external division ratio can also be changed. FIGS. 5 and 6 show settings in which the external division ratio is changed and actions resulting from it.

FIG. 5 shows a specific example when the transistor sizes (transistor characteristics) of the differential pair (101, 102) and the differential pair (103, 104) are set to be different. Other conditions are the same as the example shown in FIG. 3.

FIG. 5 shows the action in which V(T1)<V(T2) when the W/L ratio (the ratio of a channel width W to a channel length L) of the transistors in the differential pair (103, 104) is set to be smaller than the W/L ratio of the differential pair (101, 102).

Referring to FIG. 5, the same relationship in regard to the currents that flow through the respective transistors as the relationship in FIG. 3 holds. However, the characteristic curve 1 of the differential pair (101, 102) has a slope different from that of the characteristic curve 2 of the differential pair (103, 104).

For this reason, the external division ratio of the extrapolation (externally divided) output voltage of the differential amplifier in FIG. 1 is different from the case in FIG. 3: in FIG. 5, the external division ratio of V(T1) to V(T2) for the output voltage Vout toward the low potential side becomes approximately one to three. Likewise, when V(T1) is larger than V(T2) as well, the external division ratio of V(T1) to V(T2) for the output voltage Vout toward the high potential side becomes approximately one to three.

Further, when the W/L ratio of the differential pair (101, 102) is set to be smaller than the W/L ratio of the differential pair (103, 104), the characteristic curve 1 in FIG. 5 is interchanged with the characteristic curve 2. Thus, the external division ratio of V(T1) to V(T2) for the output voltage Vout can also be set to be approximately two to three.

As described above, by setting the transistor sizes (transistor characteristics) of the differential pair (101, 102) and the differential pair (103, 104) to be different, the external division ratio of V(T1) to V(T2) for the output voltage Vout can also be set to an arbitrary ratio.

FIG. 6 shows a specific example where the currents I1 and I2 that flow through the current sources 126 and 127 in FIG. 1 are set to be different. FIG. 6 shows the action in which V(T1) is smaller than V(T2) when the current I1 flown through the differential pair (101, 102) is set to be approximately twice as large as the current I2 flown through the differential pair (103, 104). Other conditions are the same as in the example shown in FIG. 3.

Referring to FIG. 6, the relationships in regard to the currents (drain-to-source currents) Ia, Ib, Ic, and Id that flow through the respective transistors 101, 102, 103, and 104 are as follows:

$$Ia+Ib=I1 \tag{10}$$

$$Ic+Id=I2 \quad (11)$$

$$Ia+Ic=Ib+Id \quad (12)$$

$$I1=I2\times 2 \quad (13)$$

When the above Equations (10) to (13) are solved, Ia and Ib are given by the following Equations (14) and (15):

$$Ia=(Ic+3\times Id)/2 \quad (14)$$

$$Ib=(3\times Ic+Id)/2 \quad (15)$$

When I1 is different from I2, simple relations such as those in FIGS. 3 through 5 do not hold. However, the output stability state of the differential amplifier in FIG. 1 becomes the sate as shown in FIG. 6.

Referring to FIG. 6, the external division ratio of V(T1) to V(T2) toward the lower potential side for the output voltage Vout becomes approximately one to three.

Likewise, when V(T1) is larger than V(T2) as well, the external division ratio of V(T1) to V(T2) toward the high potential side for the output voltage Vout becomes approximately one to three. In the example shown in FIG. 6, when the absolute values of the currents I1 and I2 change, the external division ratio also changes.

As described above, by optimally setting the currents I1 and I2, the external division ratio of V(T1) to V(T2) for the output voltage Vout can also be set to an arbitrary ratio.

Figure 7:
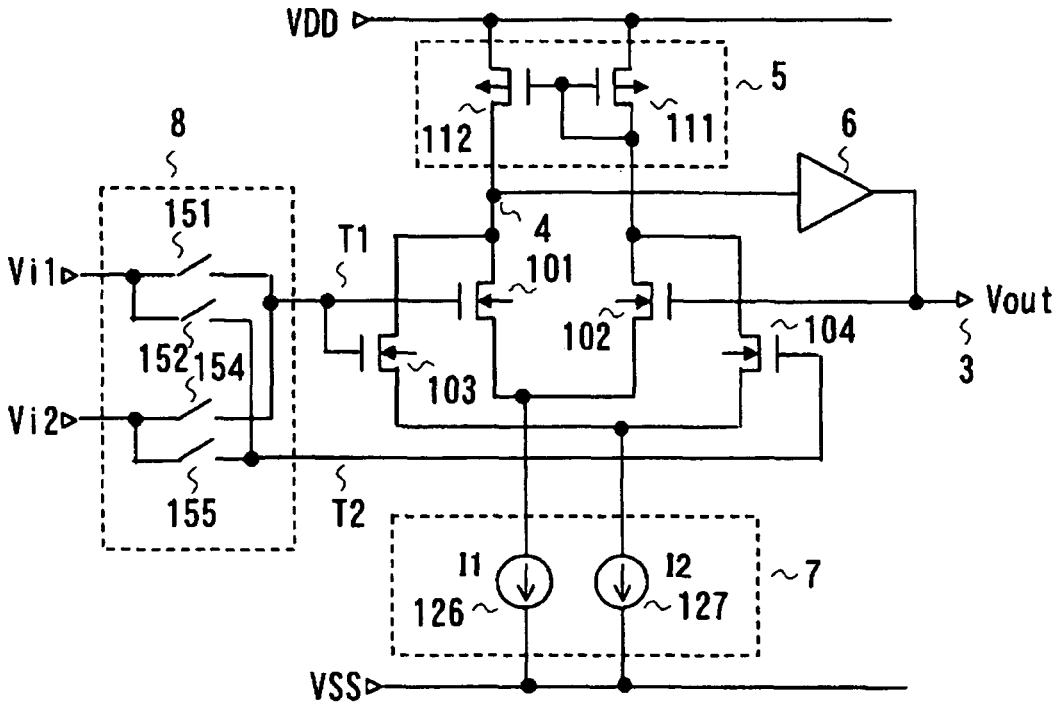
FIG. 7 is a diagram showing a configuration of a differential amplifier according to a second embodiment of the present invention.

FIG. 7 is a diagram showing a second embodiment of the present invention. Referring to FIG. 7, same reference numerals and characters are assigned to elements that are the same as or comparable to those in FIG. 1. Referring to FIG. 7, this embodiment further includes an input control circuit 8 in addition to the configuration in FIG. 1. Other configurations are same as the configuration in FIG. 1. More specifically, referring to FIG. 7, this embodiment includes the input control circuit 8 for performing control (selection) of input of two input voltages (Vi1, Vi2) to the input terminals T1 and T2 in the differential amplifier in FIG. 1. The input control circuit 8 is constituted from switches 151 and 152 connected between a terminal to which the voltage Vi1 is given and the terminals T1 and T2, respectively, and switches 154 and 155 connected between a terminal to which the voltage Vi2 is given and the terminals T1 and T2, respectively.

By controlling on and off of the switches 151, 152, 154, and 155 in the input control circuit 8, control of input of the two input voltages (Vi1, Vi2) to the terminals T1 and T2 can be performed approximately.

Figure 8:
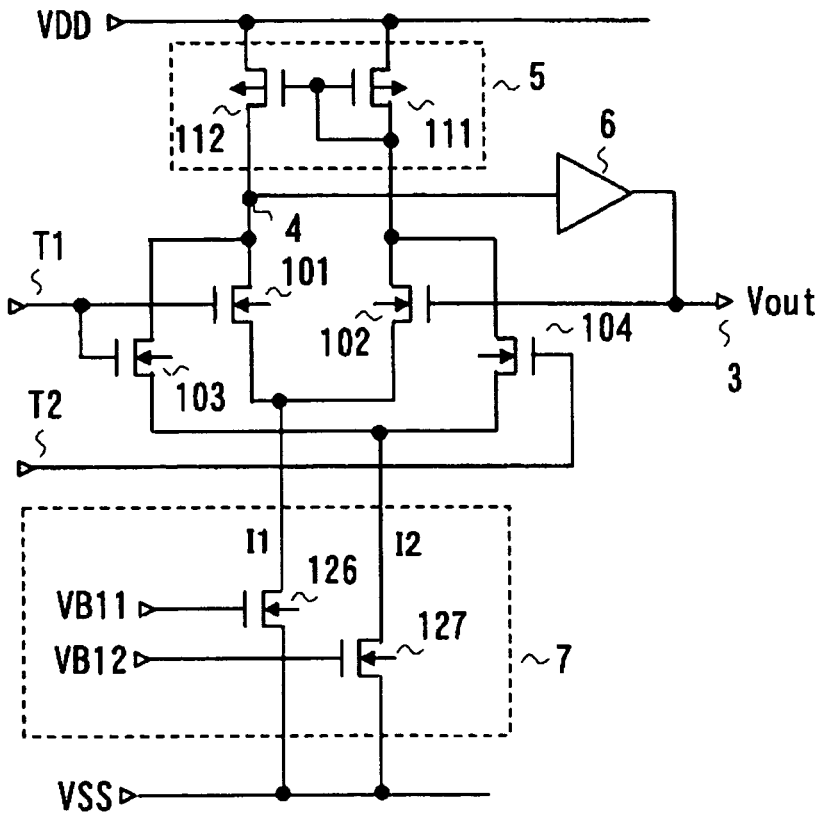
FIG. 8 is a diagram showing a configuration of a differential amplifier according to a third embodiment of the present invention.

FIG. 8 is a diagram showing a configuration of a third embodiment of the present invention. In FIG. 8, the same reference numerals and characters are assigned to the elements that are the same or comparable to those in FIG. 1. Referring to FIG. 8, a specific example of a current control circuit 7 that performs current control over the currents I1 and I2 flown through the two differential pairs (101, 102) and (103, 104) is shown.

Referring to FIG. 8, the current control circuit 7 includes the current sources 126 and 127 constituted from transistors, and bias voltages VB11 and VB12 are fed to respective gates thereof. The bias voltages VB11 and VB12 may be fixed voltages, bias levels can be changed as necessary, and the current values of the currents I1 and I2 can also be changed.

Figure 9:
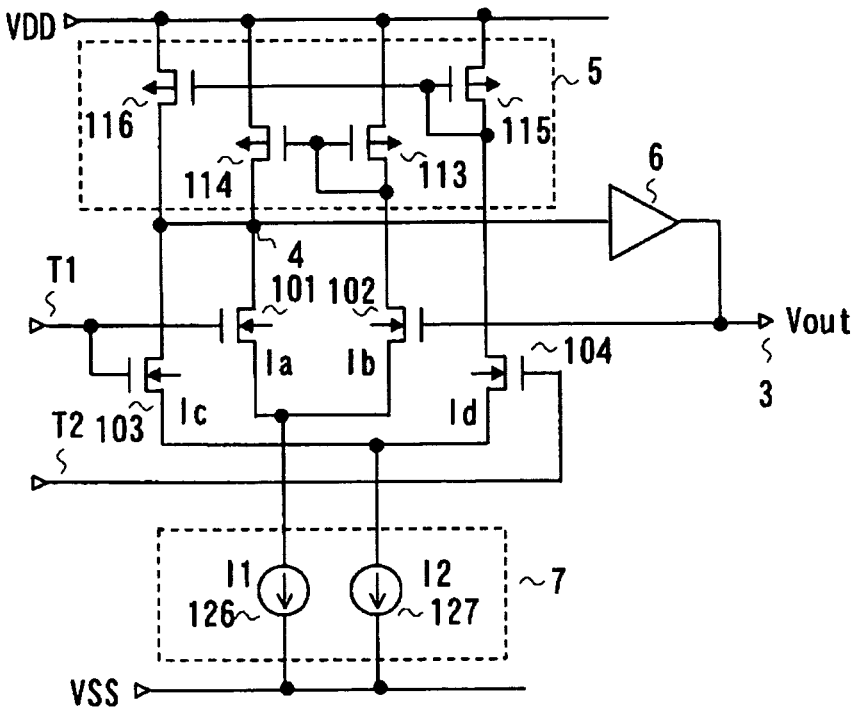
FIG. 9 is a diagram showing a configuration of a differential amplifier according to a fourth embodiment of the present invention.

FIG. 9 is a diagram showing a configuration of a fourth embodiment of the present invention, and is the diagram showing an example of a modification of the current mirror circuit 5 in the differential amplifier in FIG. 1.

Referring to FIG. 9, the same reference numerals and characters are assigned to the elements that are the same or comparable to those in FIG. 1.

In the first embodiment in FIG. 1, the current mirror circuit constituting the load circuit 5 has the configuration in which the output pairs of the two differential pairs (101, 102) and (103, 104) are connected in common to the circuit of a current mirror pair (111, 112).

On contrast therewith, as shown in FIG. 9, in the present embodiment, the current mirror circuit 5 includes current mirror circuits (113, 114) and (115, 116) separately connected to the output pairs of the differential pairs (101, 102) and (103, 104). The output terminals (respective drains of the transistors 114 and 116) of the two current mirror circuits (113, 114) and (115, 116) are connected in common, and its output signal is input to the amplification stage 6.

When the relationships in regard to the currents Ia, Ib, Ic, Id that flow through the transistors 101 to 104, respectively, in the differential amplifier shown in FIG. 9 are derived, the following Equation (16) with respect to the differential pair (101, 102) holds.

$$Ia+Ib=I1 \quad (16)$$

With respect to the differential pair (103, 104), the following Equation (17) holds.

$$Ic+Id=I2 \quad (17)$$

Since the drains of the transistors 114 and 116 are connected in common in the two current mirror circuits (113, 114) and (115, 116), the following Equation (18) holds.

$$Ia+Ic=Ib+Id \quad (18)$$

Accordingly, in the differential amplifier shown in FIG. 9 as well, relations about the currents that are the same as those in the differential amplifier shown in FIG. 1 are derived. That is, though the differential amplifier shown in FIG. 9 has a configuration different from the differential amplifier in FIG. 1, its action and effects are basically the same as the embodiment shown in FIG. 1 (in which the load circuit is provided in common to the first and second differential pairs).

In this modification example, provision of separate load circuits for the respective differential pairs becomes effective for adjustment and settings of the characteristics of the two differential pairs.

As the current mirror circuit 5 constituting the load circuit, the simplest current mirror circuit is shown in each of the drawings showing the embodiments of the present invention. However, any configuration in which a plurality of cascode-type current mirror circuits are stacked may also be used.

Referring to FIGS. 1 to 9, though the differential amplifiers provided with the two n-channel differential pairs (101, 102) and (103, 104) were described, the same effects and actions can be of course obtained from differential amplifiers provided with two p-channel differential pairs.

Further, the differential amplifier including both n-channel differential pairs and p-channel differential pairs is generally well known so as to implement a wide output range, and the present invention can also be applied to the differential amplifier as well.

Figure 10:
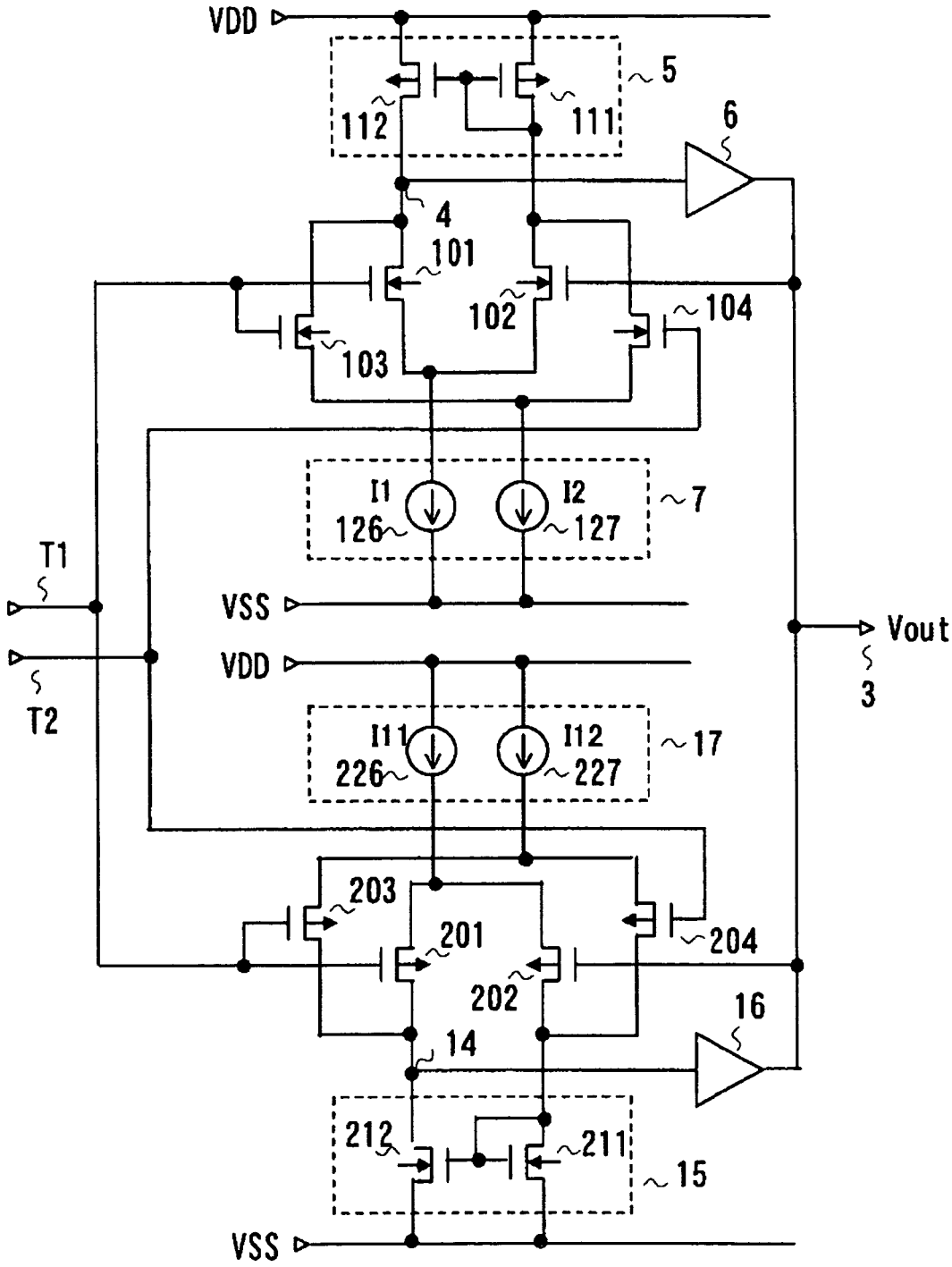
FIG. 10 is a diagram showing a configuration of a differential amplifier according to a fifth embodiment of the present invention.

FIG. 10 is a diagram showing a configuration according to a fifth embodiment of the present invention. The present embodiment provides a specific example of a differential amplifier provided with two p-channel differential pairs and two n-channel differential pairs, which expands an operable range.

Referring to FIG. 10, the differential amplifier in FIG. 10 includes the n-channel differential pair (101, 102) driven by the current source 126 connected to a low-potential power supply VSS, the n-channel differential pair (103, 104) driven by the current source 127 connected to the low potential power supply VSS, the current mirror circuit 5 (constituted from the p-channel transistors 111, 112) connected between the output pairs of the two n-channel differential pairs and a high-potential power supply VDD, which constitutes a common active load for the respective output pairs of the two n-channel differential pairs, and the amplification circuit 6 for inputting the output signal of the current mirror circuit 5 and outputting a voltage to the output terminal 3. The current sources 126 and 127 for supplying currents I1 and I2 flown through the respective two n-channel differential pairs are provided in the current control circuit 7.

The differential amplifier further includes a p-channel differential pair (201, 202) driven by a current source 226 connected to the high-potential power supply VDD, a p-channel differential pair (203, 204) driven by a current source 227 connected to the high-potential power supply VDD, a current mirror circuit 15 (constituted from n-channel transistors 211, 212) connected between the output pairs of the two p-channel differential pairs and the low-potential power supply VSS, which constitutes a common active load for the output pairs of the two p-channel differential pairs, and an amplification circuit 16 for inputting the output signal of the current mirror circuit 15 and outputting a voltage to the output terminal 3.

Current sources 226 and 227 for supplying currents I11 and I12 flown through the two p-channel differential pairs, respectively, are provided in a current control circuit 17. With regard to the respective input pairs (gate terminals) of the differential pairs, the gates of the transistors 101, 103, 201, and 203 are connected in common to the input terminal T1, the gates of the transistors 104 and 204 are connected in common to the input terminal T2, and the gates of the transistors 102 and 202 are connected in common to the output terminal 3.

The amplification circuit 6, for example, may have a configuration including a charging element such as a p-channel transistor (not shown) with the output terminal (4) of the n-channel differential pair (101, 102) input to a gate thereof, a source thereof connected to the power supply VDD, and a drain thereof connected to the output terminal 3, and a discharging element for a constant current source (not shown) connected between the output terminal 3 and the power supply VSS.

Likewise, the amplification circuit 16 may have a configuration including a charging element such as an n-channel transistor (not shown) with an output (14) of the p-channel differential pair (201, 202) input to a gate thereof, a source thereof connected to the power supply VSS, and a drain thereof connected to the output terminal 3, and a discharging element such as a constant current source (not shown) connected between the output terminal 3 and the power supply VDD.

In the differential amplifier in the present embodiment shown in FIG. 10 as well, by selectively inputting two input voltages to the terminals T1 and T2, four voltage levels of the two input voltages and voltages extrapolated from the two input voltages (or externally divided voltages) can be output.

The above description was directed to the embodiments of the differential amplifier according to the present invention. The differential amplifier according to the present invention may be implemented as follows:

(A) A differential amplifier according to the present invention may be a voltage follower differential amplifier in which one of the input pair of one differential pair is connected to an input terminal thereof and the other is feedback connected to an output terminal thereof. The differential amplifier may further include other differential pair with an output pair thereof connected in common to the output pair of the one differential amplifier, one of an input pair thereof connected to the input terminal thereof, and the other of the input pair thereof connected to an input terminal different from the input terminal thereof. In the differential amplifier in FIG. 1, for example, by causing the circuit constituted from the differential pair (101, 102), current source 126, current mirror circuit (111, 112), and amplification stage 6 to constitute the voltage follower differential amplifier for outputting a voltage at the input terminal T1 to the output terminal 3, and in addition to this, by providing the current source 127 and the differential pair (103, 104) with an output pair thereof connected in common to the output pair of the differential pair (101, 102) and an input pair thereof connected to the input terminal T1 and the input terminal T2, the differential amplifier according to the present invention is thereby implemented. Further, the present invention can be easily applied to a differential amplifier including differential pairs having mutually different polarities as well. In the case of the differential amplifier shown in FIG. 10, for example, by further providing the n-channel differential pair (103, 104) and the p-channel differential pair (203, 204) with output pairs thereof connected in common to the output pairs of the differential pairs (101, 102) and (201, 202), respectively, and respective input pairs thereof connected to the input terminal T1 and the input terminal T2, current source 127, and current source 227 to the voltage follower differential amplifier having the n-channel differential pair (101, 102) and the p-channel differential pair (201, 202), the differential amplifier according to the present invention can be implemented.

(B) Alternatively, as the differential amplifier according to the present invention, the voltage follower differential amplifier having an amplification stage and a first differential stage with one of the differential input pair connected to an input terminal thereof and the other feedback connected to an output terminal thereof may further include a second differential stage. The amplification stage is connected between the output terminal of the first differential stage and the output terminal thereof. In the second differential stage, one of a differential input pair is connected to the input terminal thereof, the other is connected to an input terminal different from the input terminal thereof, and an output terminal thereof connected in common to the output terminal of the first differential stage. In the differential amplifier in FIG. 9, for example, by causing the circuit constituted from the first differential stage including the differential pair (101, 102), current source 126, and current mirror circuit (111, 112) and the amplification stage 6 connected between the output terminal 4 of the first differential stage and the output terminal 3 to constitute the voltage follower differential amplifier for outputting a voltage at the input terminal T1 to the output terminal 3, and for this, by providing a second differential stage, the differential amplifier according to the present invention is implemented. The second differential stage includes the differential pair (103, 104) with an input pair thereof connected to the input terminals T1 and T2, current source 127, and current mirror circuit (115, 116), and an output terminal thereof is connected in common to the output terminal 4 of the first differential stage. Likewise, the differential amplifier according to the present invention may also be applied to the differential amplifier including differential pairs having mutually different polarities.

Next, a result of simulation that demonstrates an operation and an effect of the differential amplifier of the present invention will be described with reference to the drawings.

Figure 11:
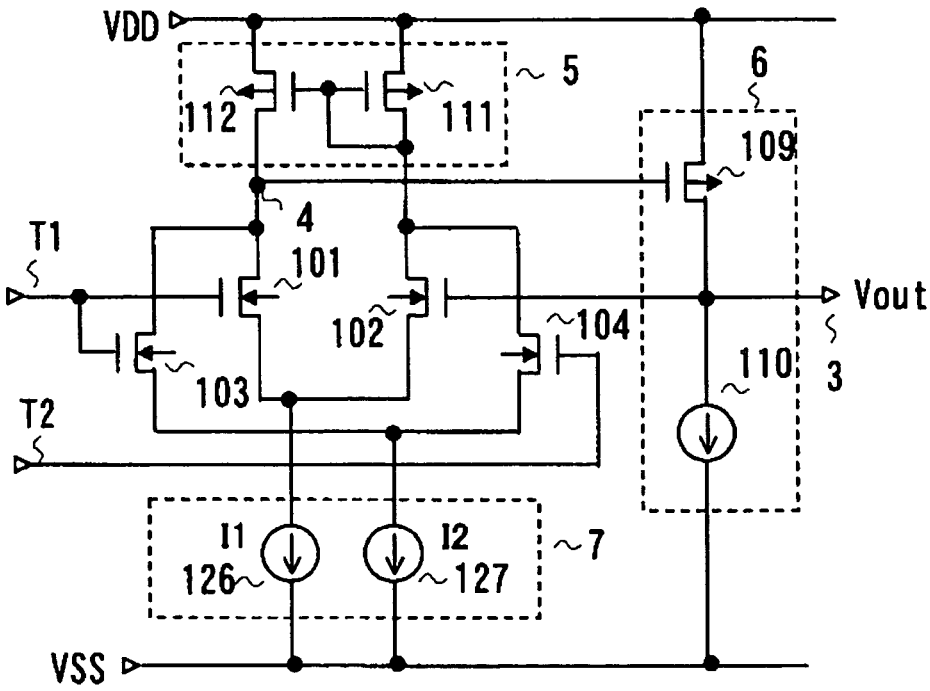
FIG. 11 is a diagram showing a configuration of a differential amplifier (a circuit for simulation) according to a fifth embodiment of the present invention.
Figure 36:
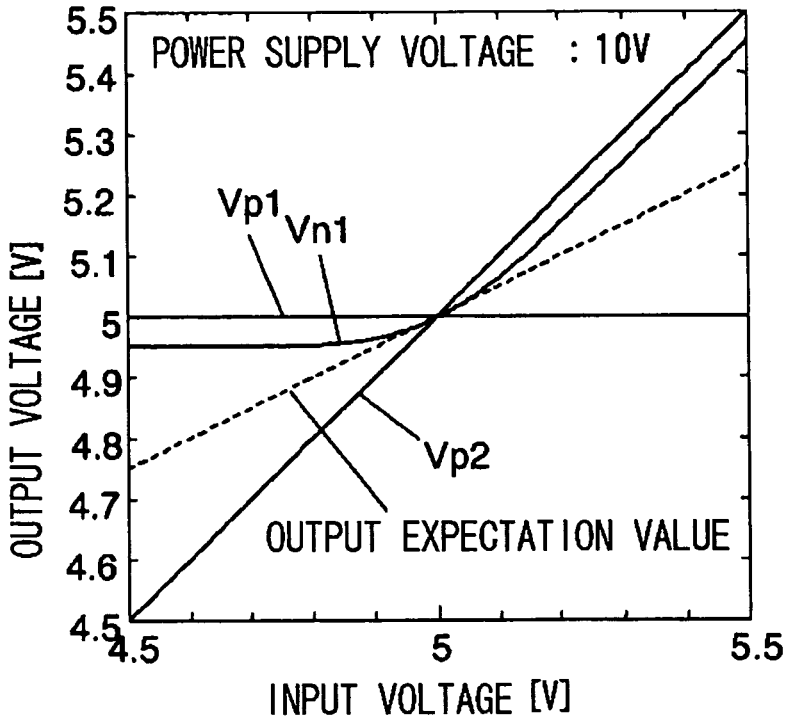
FIG. 36 is a graph showing an example of the input-output characteristics (DC characteristics) of the differential amplifier in FIG. 32.

FIG. 11 is a diagram showing a configuration of the differential amplifier used in the simulation. FIG. 11 shows a specific example in FIG. 1. The amplification stage 6 is constituted from a p-channel transistor 109 and a current source 110. Other configurations are the same as those shown in FIG. 1. The transistor 109 is connected between the high-potential power supply VDD and the output terminal 3, and its gate is connected to the output terminal (the drain of the transistor 112) of the current mirror circuit (111, 112). The current source 110 is connected between the low-potential power supply VSS and the output terminal 3. Though not shown in FIG. 11, a phase compensating capacitance is provided between the transistor 109 and the output terminal 3, as necessary. Incidentally, it is assumed that the transistors 101 to 104 in FIG. 11 have the same size and the currents I1 and I2 flown through the two current sources 126 and 127 are set to be equal. Further, in order to make comparison with the performance of the conventional art, in the differential amplifier in FIG. 11, the sizes of the respective transistors of the differential pairs, current mirror circuits, and amplification circuit and the current values of the current sources are set to substantially the same conditions as the differential amplifier in FIG. 32 having input-output characteristics shown in FIG. 36.

Figure 12:
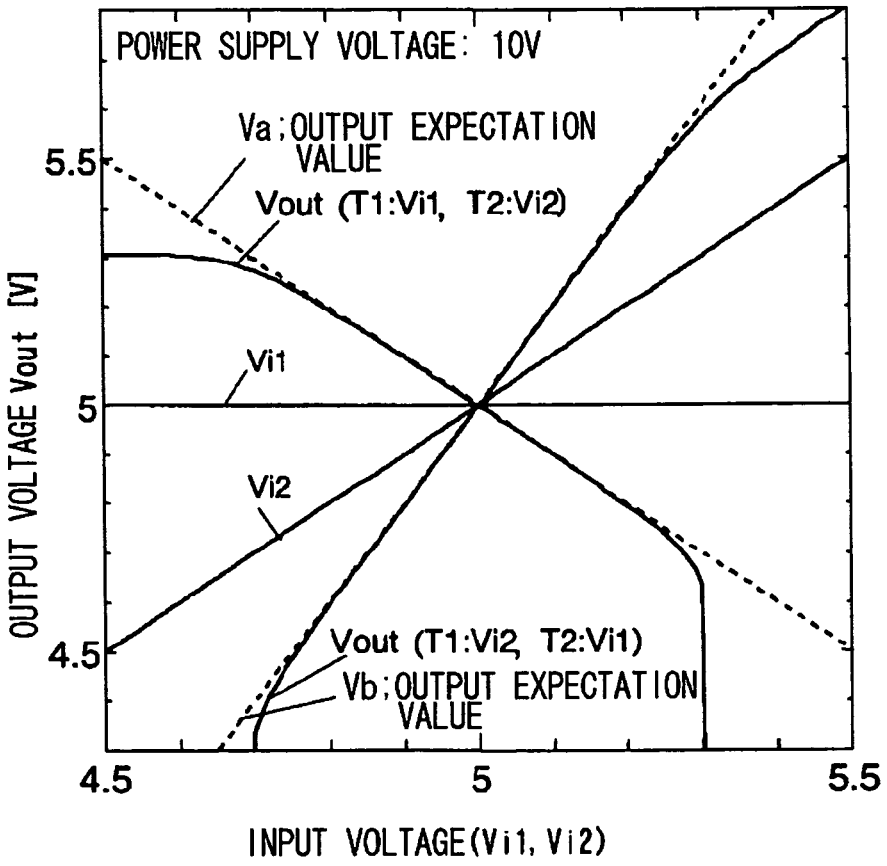
FIG. 12 is a graph showing input-output characteristics (DC characteristics) of the differential amplifier in the sixth embodiment of the present invention.

FIG. 12 is a graph showing the result of simulation of the output characteristics of the differential amplifier in FIG. 11. FIG. 12 shows the characteristics of the output voltage Vout when input voltages to the terminals T1 and T2 (V(T1), V(T2)) are (Vi1, Vi2), (Vi2, Vi1), respectively. In the simulation, the voltage Vi1 of the two input voltages (Vi1, Vi2) was fixed, and the voltage Vi2 was changed with respect to Vi1 in the range of ±0.5 V.

When the transistors 101 to 104 are set to have the same size and the currents I1 and I2 are set to be equal, the output voltage Vout becomes the voltage obtained by externally dividing the V(T1) and the V(T2) at the ratio of one to two. Thus, these output expectation values are indicated by dotted lines Va and Vb in FIG. 12.

When the voltages Vi1 and Vi2 are applied to the terminals T1 and T2, respectively, the following Equation (19) is derived from the Equation (8).

$$Va=Vi1+(Vi1-Vi2) \tag{19}$$

The output voltage Va becomes the voltage obtained by adding a potential difference (Vi1−Vi2) between the voltages Vi1 and Vi2 to the voltage Vi1.

When the voltages Vi2 and Vi1 are applied to the terminals T1 and T2, respectively, the following Equation (20) holds.

$$Vb=Vi2-(Vi1-Vi2) \tag{20}$$

Thus, the output voltage Vb becomes the voltage obtained by subtracting the potential difference (Vi1−Vi2) between the voltages Vi1 and Vi2 from the voltage Vi2.

From FIG. 12, it was confirmed that when the two externally-divided Vout were in the range of approximately 0.75V (when Vi1 and Vi2 were in the range of 5+0.25V), the output voltages Vout thouroughly coincide with the output expectation values (Va, Vb), and that the differential amplifier in FIG. 11 could output the externally-divided (extrapolation) voltages using the two input voltages over a wide voltage range with high precision.

Referring to FIG. 12, when the externally divided (extrapolation) voltage using the two input voltages is precisely output, the voltage difference between the voltages V(T1) and V(T2) has the upper limit, as described in FIGS. 3 and 4.

From FIG. 12, it can be seen that when the difference between the input voltages V(T1) and V(T2) has exceeded approximately 0.25V (or when the difference between the Vi1 and the Vi2 is ±0.25V), (or when the input voltages were 5±0.25V), abrupt deviations from the output expectation values occur. This indicates that the upper limit of the voltage difference between the V(T1) and the V(T2) in the simulation shown in FIG. 12 is approximately 0.25 V. When the current I1 (=I2) is increased, the range of this upper limit also expands.

When the transistor constituting the differential amplifier has the channel length modulation effect, or when the drain current of the transistor has dependency on the drain-to-source voltage in the saturation region, the output voltage Vout is sometimes shifted from the output expectation values, even if the voltage difference between the voltages V(T1) and V(T2) is within the normal operating range. This is because when the voltage difference between the voltages V(T1) and V(T2) greatly expands, the voltage difference in the drain-to-source voltages greatly differ among the differential pairs, so that a deviation of the transistor characteristics (such as the characteristic curves in FIGS. 3 and 4) among the differential pairs is generated, so that the output voltage Vout thereby deviates from the output expectation value.

Figure 32:
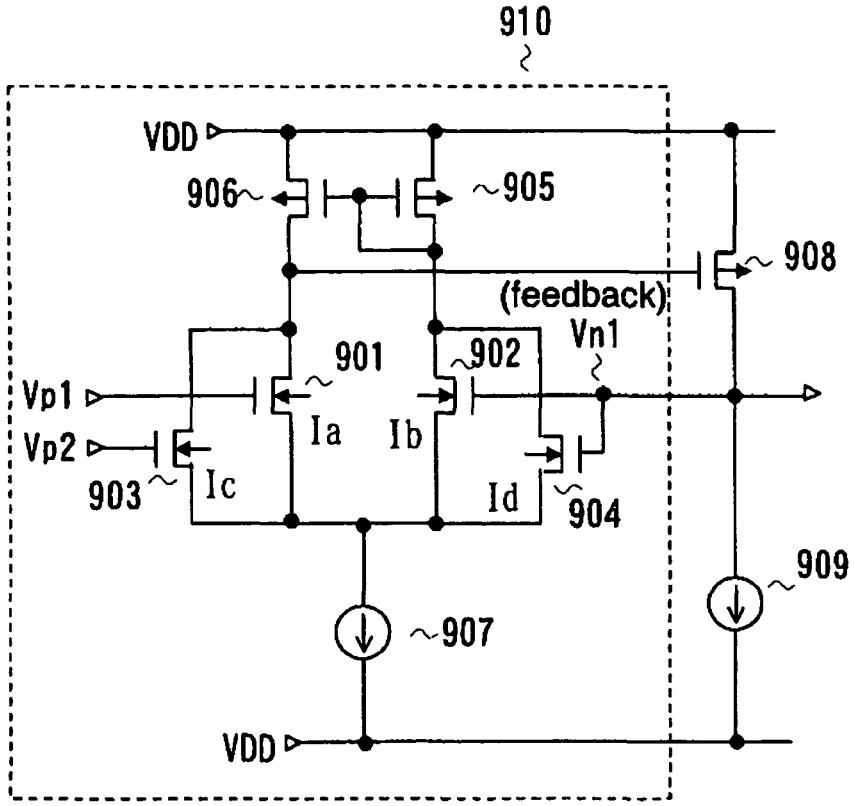
FIG . 32 PRIOR ART
FIG. 32 is a diagram showing a configuration of a differential amplifier (based on conjecture of the inventor of the present invention) described in patent document 1.
Figure 33:
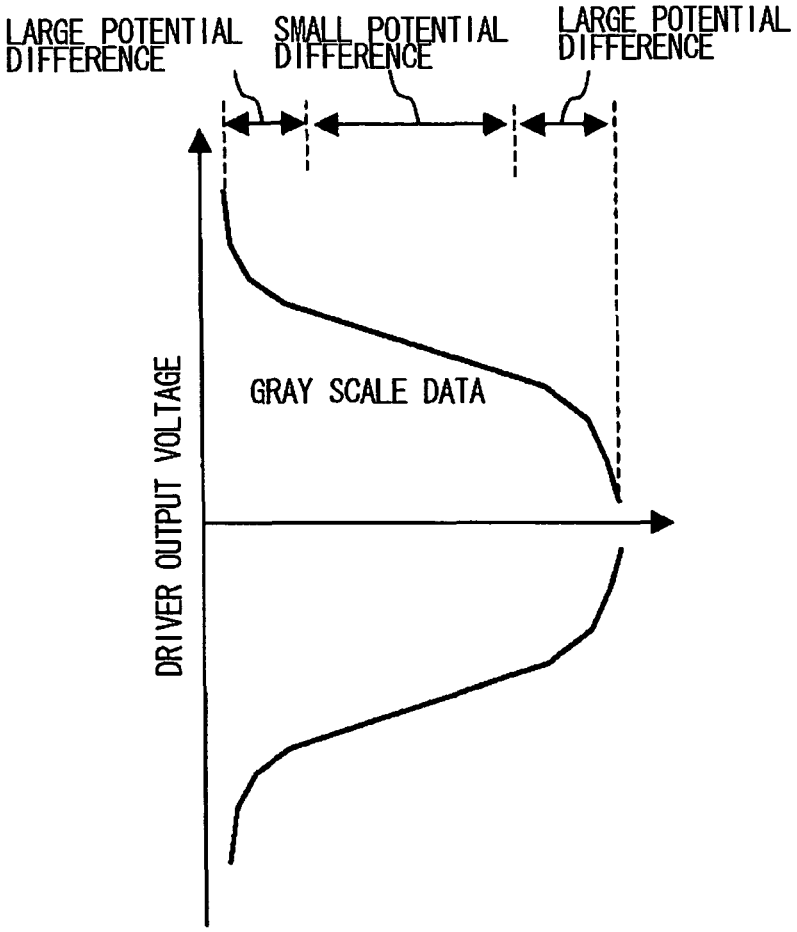
FIG . 33 PRIOR ART
FIG. 33 is a graph showing an output voltage characteristic of the data driver.
Figure 34:
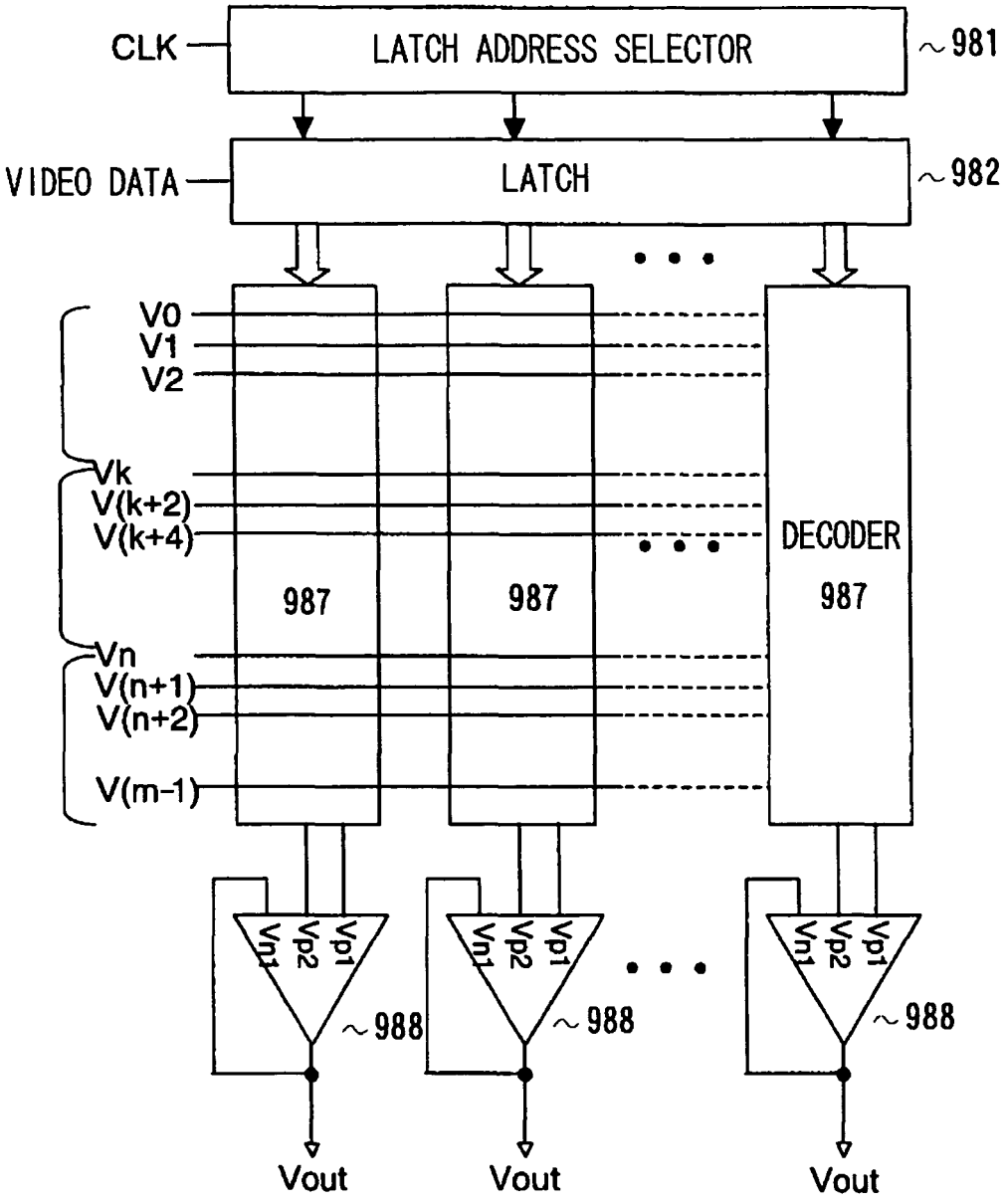
FIG . 34 PRIOR ART
FIG. 34 is a diagram showing a configuration of a data driver described in patent document 1.
Figure 35:
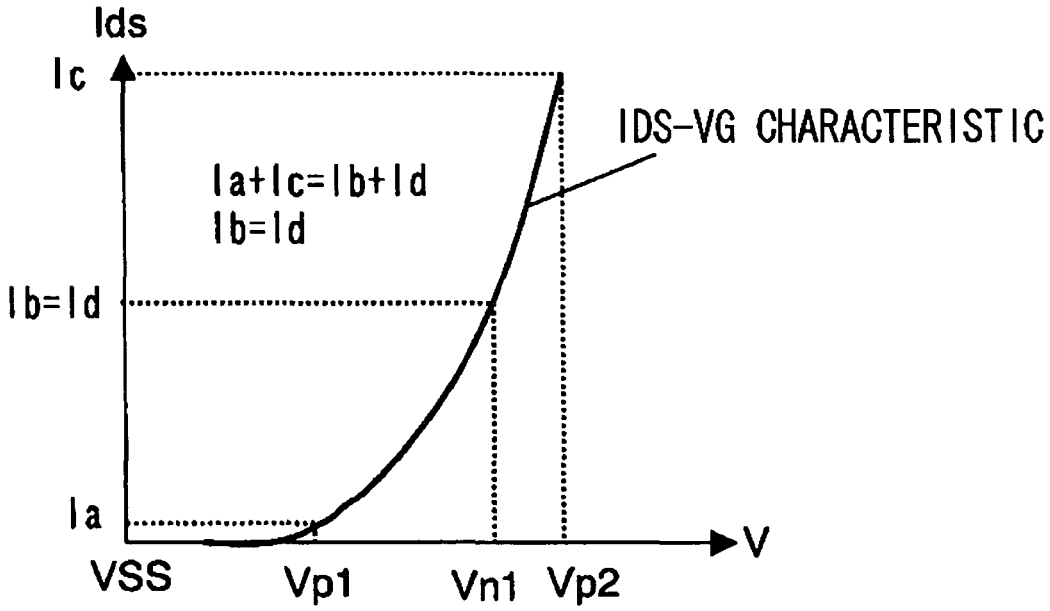
FIG. 35 is a graph for explaining an operation of the differential amplifier in FIG. 32 from its current-voltage characteristics.

In the example shown in FIG. 12, when the voltage difference between the two input voltages is within the range of approximately ±0.25 V (when the respective input voltages are 5±0.25V), the output voltages Vout coincides with the output expectation values with high precision. It was therefore confirmed that, compared with the output characteristics of the differential amplifier (of the conventional configuration) in FIG. 32, shown in FIG. 36, output with high precision is possible over a sufficiently wide voltage range due to these output characteristics.

Figure 13:
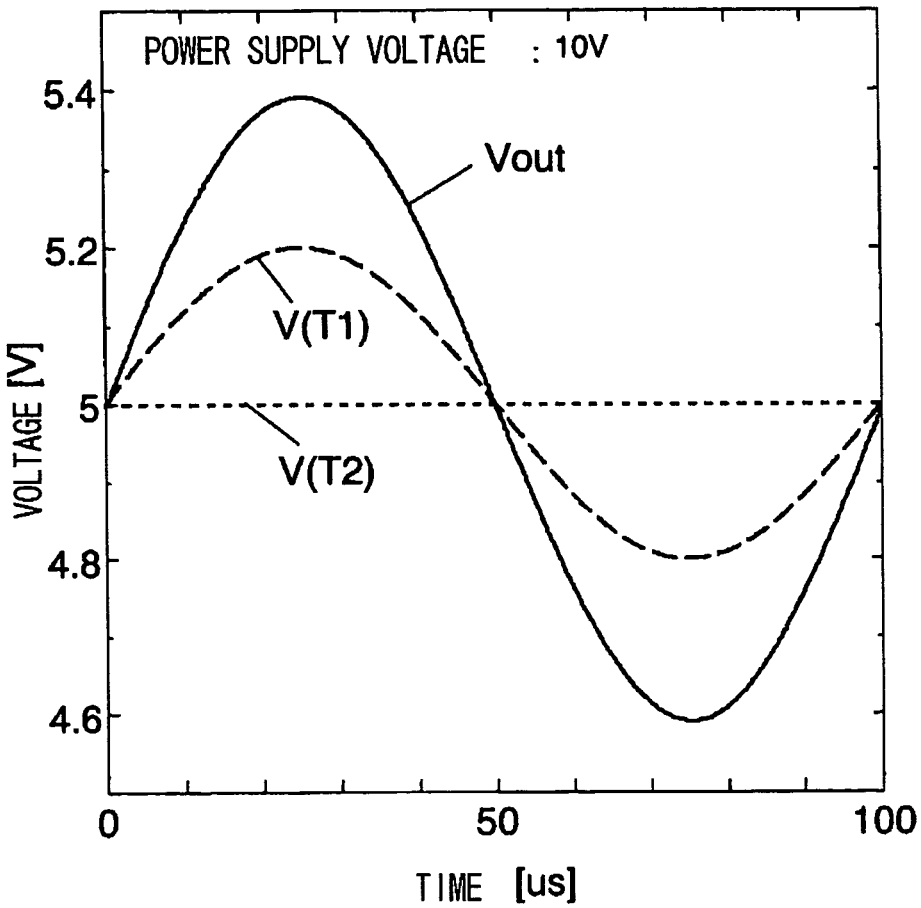
FIG. 13 is a graph showing input-output characteristics (AC characteristics) of the differential amplifier in the sixth embodiment of the present invention.
Figure 14:
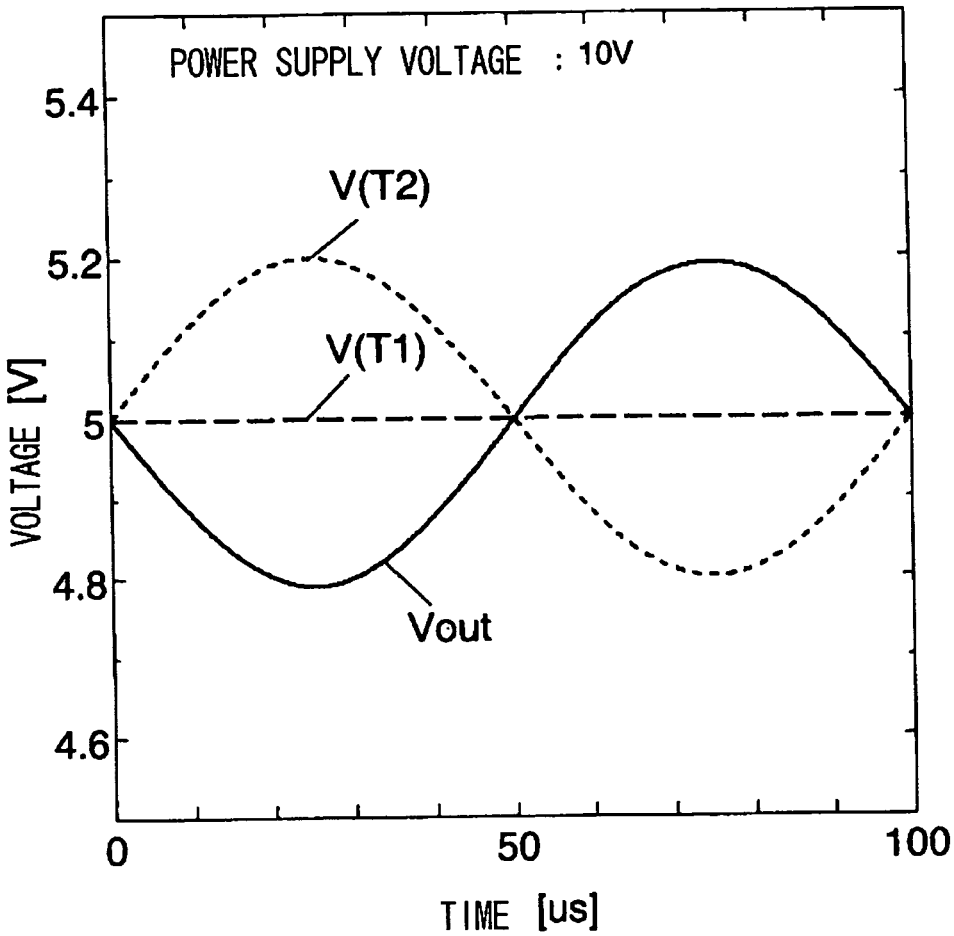
FIG. 14 is a graph showing input-output characteristics (AC characteristics) of the differential amplifier in the sixth embodiment of the present invention.

FIGS. 13 and 14 are graphs showing voltage waveforms at the output terminal when different input signals (AC signals) are input to the input terminals T1 and T2 in the differential amplifier in FIG. 11.

FIG. 13 shows the output waveform when a sine wave with an amplitude of 0.2V centering at 5V is input as the input voltage V(T1) to the first input terminal T1 in FIG. 11 and a 5V constant voltage is input to the second input terminal T2 as the input voltage V(T2). The differential amplifier in FIG. 11 outputs a voltage obtained by external division of V(T1) and V(T2) at the ratio of one to two. Thus, the output voltage Vout becomes the sine wave having an amplitude of 0.4V centering at 5V.

$$Vout+V(T2)=2\times V(T1).$$

FIG. 14 is a graph showing a result when the inputs shown in the example in FIG. 13 are interchanged, and indicates the output waveform when the 5V constant voltage is input to the input terminal T1 as the input voltage V(T1) and the sine wave with an amplitude of 0.2V centering at 5V is input to the input terminal T2 as the input voltage V(T2). In this case, as shown in FIG. 14, the output voltage Vout becomes the sine wave with an amplitude of 0.2V centering at 5V (having an opposite phase to that of V(T2)), as shown in FIG. 14.

As shown in FIGS. 13 and 14, when a fixed voltage and a signal having a given frequency are input to the input terminals T1 and T2 of the differential amplifier in FIG. 11, respectively, an output signal in phase with the input signal and having an amplitude twice as large as the amplitude of the input signal and an output signal having a phase opposite to the phase of the input signal can be obtained. When various signals are input to the input terminals T1 and T2 with the voltage differences between the voltages V(T1) and V(T2) being within the range in which the differential amplifier is normally operable, various output signals can be obtained.

Figure 15:
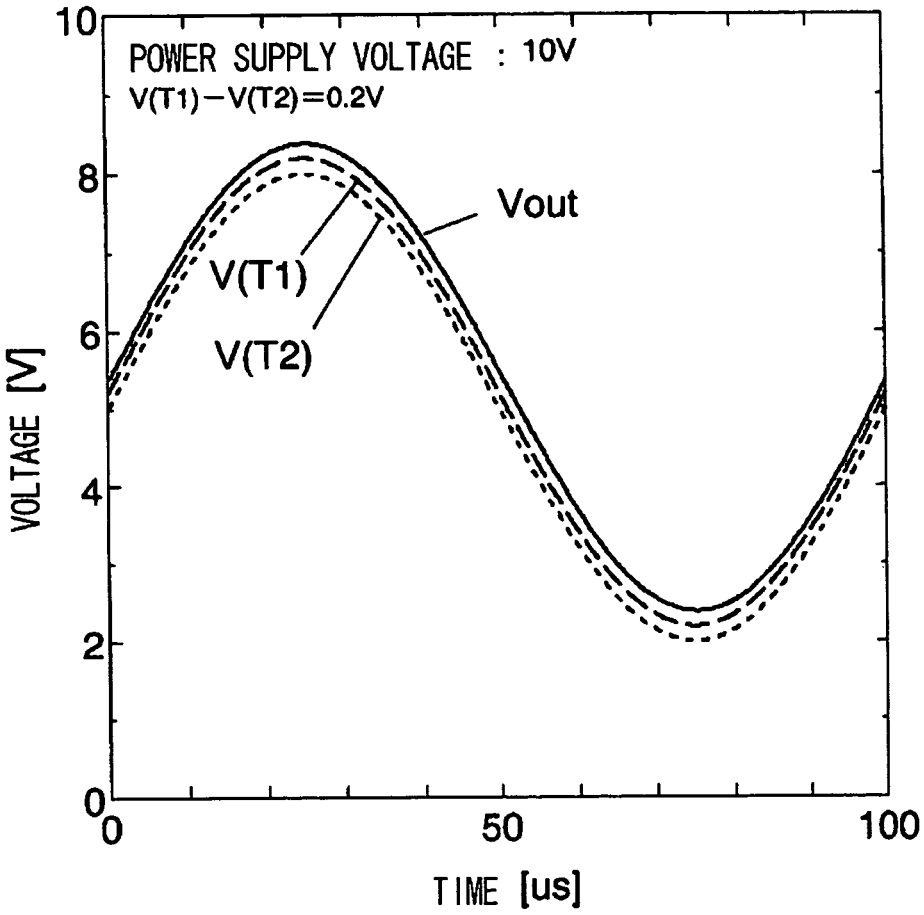
FIG. 15 is a graph showing input-output characteristics (AC characteristics) of the differential amplifier in the sixth embodiment of the present invention.

FIG. 15 shows an output waveform when a sine wave having an amplitude of 3V centering at 5.2V is input as the input voltage V(T1) to the input terminal T1 and a sine wave having an amplitude of 3V centering at 5.0V is input as the input voltage V(T2) to the input terminal T2 in the differential amplifier in FIG. 11. The upper limit to the voltage difference between the voltages V(T1) and V(T2) is approximately 0.25V in the differential amplifier in FIG. 11.

Thus, referring to FIG. 15, two input signals that fixes the voltage difference between the voltages V(T1) and V(T2) at 0.2V are input to the input terminals T1 and T2. Under the condition in which the possible range of the voltage difference between the voltages V(T1) and V(T2) is satisfied, the dynamic range of the differential amplifier in FIG. 11 can be sufficiently increased.

The performance in the case of a voltage follower configuration in which the voltage V(T1) to the first input terminal T1 is equal to the voltage V(T2) to the second input terminal T2 may be defined as the reference performance of the differential amplifier in FIG. 11.

Even if the V(T1) is different from the V(T2), and if the voltage difference is in the possible range of the voltage difference between the voltages V(T1) and the V(T2), the dynamic range substantially close to the reference performance can be achieved, though there is a margin corresponding to the voltage difference.

Next, the slew rate (a transient response characteristic) of the differential amplifier in FIG. 11 will be described.

Figure 16A:
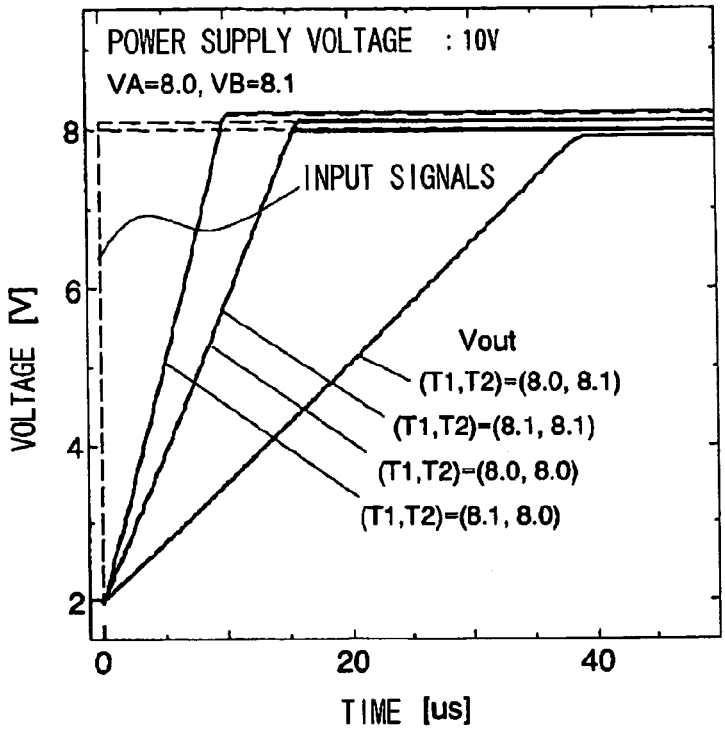
FIG. 16A is a graph showing input and output transitional characteristics of the differential amplifier in the sixth embodiment of the present invention.
Figure 16B:
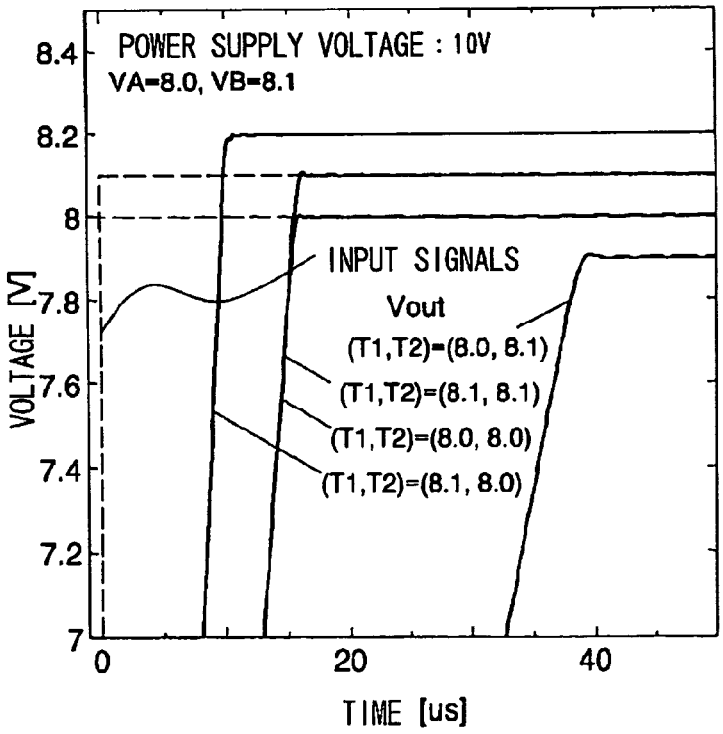
FIG. 16B is a partially enlarged view of FIG. 16A.

FIG. 16A is a graph showing output waveforms (changes in respective voltage levels) of total four levels of two voltages equal to input voltages and two extrapolation voltages when two input voltages are selectively input to the input terminals T1 and T2 in the differential amplifier in FIG. 11. FIG. 16B is a partially enlarged view of FIG. 16A.

FIGS. 16A and 16B show changes in four voltage levels (transient response characteristics) after the selection states of the input voltages to the input terminals T1 and T2 (indicated by broken lines) are switched from around 2V to around 8V at a time 0 μs. The two input voltages (A, B) after the switching of selection were indicated by A=8.0 V, and B=8.1 V.

Accordingly, due to selective inputs of these two voltages (A, B), the differential amplifier in FIG. 11 can output four voltage levels of the voltage Vout of 7.9 V, 8.0 V, 8.1 V, and 8.2V.

FIG. 16B is the enlarged view of FIG. 16A around 8V, in which rising waveforms indicated by broken lines indicate input signal voltages.

From FIGS. 16A and 16B, it can be seen that the differential amplifier in FIG. 11 has different slew rates when the respective four levels are output. With respect to the slew rates of the respective levels, the slew rates when the voltages (Vout=8.0 V, 8.1 V) equal to the two input voltages (A, B) are output are both equal. When the extrapolation voltage (Vout=7.9 V) lower than the two input voltages (A, B) is output, the slew rate becomes lower. When the extrapolation voltage (Vout=8.1 V) higher than the two input voltages (A, B) is output, the slew rate becomes higher.

After the cause of the differences in the slew rate was analyzed, it was found that the indirect action of the differential pair (103, 104) leads to the differences. The slew rate of the differential amplifier in FIG. 11 depends on the magnitude of the action of reducing the output signal voltage of the current mirror circuit. It is generated by synthesis of the actions of the two differential pairs (101, 102) and (103, 104).

With respect to this, the respective operations of the two differential pairs (101, 102) and (103, 104) will be described below. The respective drain currents of the two differential pairs (101, 102) and (103, 104) are indicated by Ia, Ib, Ic, and Id, as in FIG. 1, the voltages supplied to the terminals T1 and T2 are indicated by V(T1) and V(T2), respectively, and the description will be given below.

First, the operation of the differential pair (101, 102) will be described. One of the pair of the inputs of the differential pair (101, 102) is connected to the input terminal T1, and the other is connected to the output terminal 3. Thus, after the selection state of the input voltage has been switched from around 2V to around 8V, the current Ia that flows through the transistor 101 increases, and the current Ib that flows through the transistor 102 decreases according to a potential difference between the voltage V(T1) and the output voltage Vout. The action of reducing the output signal voltage of the current mirror circuit 5 is thereby caused. Accordingly, in this case, the slew rate is considered to increase as the increment of the current Ia increases.

On the other hand, one of the pair of the inputs of the differential pair (103, 104) is connected to the input terminal T1, and the other is connected to the input terminal T2. Thus, immediately after the selection state of the input voltage has been switched from around 2V to around 8V, the current Ic that flows through the transistor 103 and the current Id that flows through the transistor 104 are controlled to be given currents in accordance with the voltages V(T1) and V(T2), respectively. For this reason, the differential pair (103, 104) does not directly contribute to the action of reducing the output signal voltage of the current mirror circuit 5. However, the differential pair (103, 104) affects variations in the current Ia through the magnitude of the currents Ic and Id controlled to be constant according to the voltages V(T1) and V(T2), respectively. This is because the currents that flow through the respective transistors in the two differential pairs function to maintain the relationship (Ia=Id, Ic=Id) given by Equation (7).

When V(T1)=V(T2), the currents Ic and Id that flow through the differential pair (103, 104) are equal to each other. Thus, the currents Ia and Ib that flow through the differential pair (101, 102) also function to maintain the relation of Ia=Ib=I1/2. For this reason, the maximum value (I1−Ia) of the increment of the current Ia becomes I1/2. Thus, the slew rate changes according to the increment of the current Ia.

On the other hand, in regard to the currents Ic and Id that flow through the differential pair (103, 104), when V(T1) is larger than V(T2), the current Ic becomes larger than the current Id. Accordingly, the currents Ia and Ib that flow through the differential pair (101, 102) function to maintain the relation of Ia<Ib. For this reason, the maximum value (I1−Ia) of the increment of the current Ia is larger than I1/2. Thus, the slew rate becomes higher than in the case where V(T1) is equal to V(T2).

When V(T1) is smaller than V(T2), in regard to the currents Ic and Id that flow through the differential pair (103, 104), the current Ic becomes smaller than the current Id. Accordingly, the currents Ia and Ib that flow through the differential pair (101, 102) function to maintain the relation of Ia>Ib. For this reason, the maximum value (I1−Ia) of the increment of the current Ia becomes smaller than I1/2. Thus, the slew rate becomes lower than in the case where V(T1) is equal to V(T2).

As described above, according to the condition of selecting the two input voltages (A, B) input to the input terminals (T1, T2), the increment of the current Ia for the transistor 101 differs, so that the magnitude of the action of reducing the output terminal voltage of the current mirror circuit 5 changes. This leads to the difference in the slew rates for the four levels in FIG. 13.

As described above, when the slew rates greatly differ according to the output level even though the four levels are sufficiently close to each other, inconvenience might be caused.

Accordingly, a configuration in which the slew rates for the respective levels are made constant will be described as other embodiment of the present invention.

Figure 17:
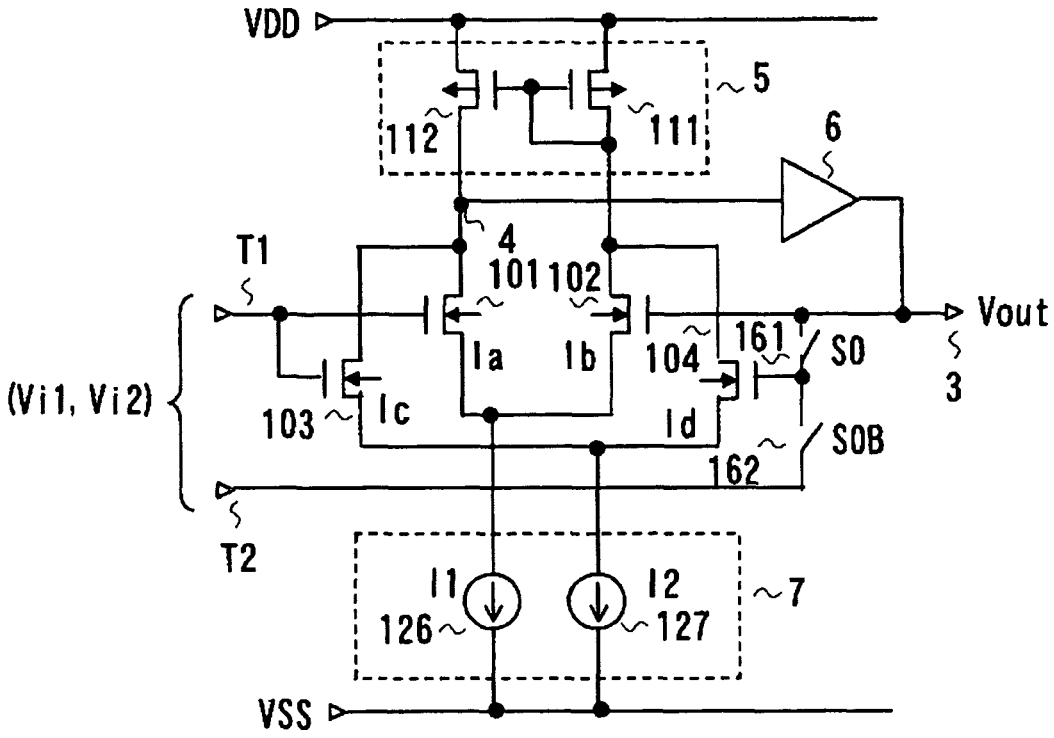
FIG. 17 is a diagram showing a configuration of a differential amplifier according to a seventh embodiment of the present invention.

FIG. 17 is a diagram showing a configuration according to a seventh embodiment of the present invention. Referring to FIG. 17, same reference numerals and characters are assigned to the elements that are the same as or comparable to those in FIG. 1. The present embodiment provides the configuration of compensating for reduction of the slew rate described above, and is the configuration in which the slew rates of the differential amplifiers in the embodiments described before in FIGS. 1 and 11 are improved. Referring to FIG. 17, in the differential amplifier in this embodiment, the control terminal of the transistor 104 of the differential pair (103, 104) is connected to the output terminal 3 and the input terminal T2 through switches 161 and 162, respectively.

Figure 18:
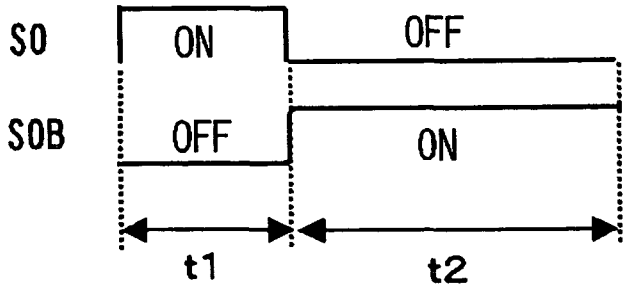
FIG. 18 is a diagram showing switching control in the differential amplifier in the seventh embodiment of the present invention.

FIG. 18 is a diagram showing control timings of the switches 161 and 162 in FIG. 17 for one output period. The switches 161 and 162 are controlled by a control signal S0 and its inverted signal S0B, and are controlled so that when one is switched on, the other is switched off. Then, in a period t1 after the start of the one output period, the switches 161 and 162 are switched to be on and off, respectively, so that the control terminal of the transistor 104 is connected to the output terminal 3. At this point, one of the input pair of each of the two differential pairs (101, 102) and (103, 104) is connected to the input terminal T1, and the other is connected to the output terminal 3. For this reason, the differential amplifier shown in FIG. 17 becomes the voltage follower configuration, so that the output voltage Vout is temporarily driven to the voltage equal to the voltage input to the input terminal T1.

Then, in a period t2 following the period t1, the switches 161 and 162 are switched off and on, respectively, and the control terminal of the transistor 104 is connected to the input terminal T2. With this arrangement, the output voltage Vout changes from the voltage driven in the period t1 to the voltage responsive to the voltages supplied to the input terminals (T1, T2).

Figure 19A:
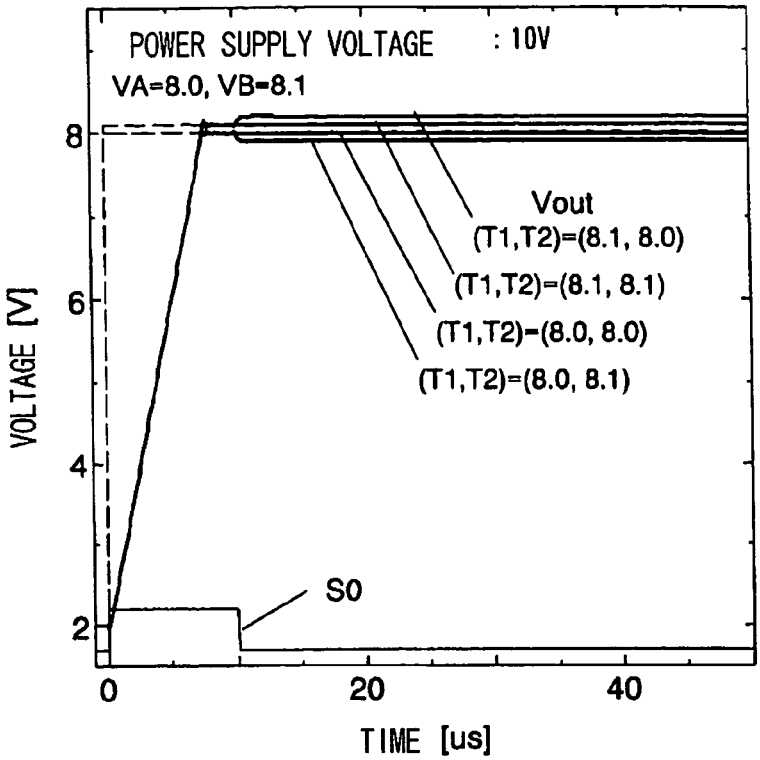
FIG. 19A is a graph showing input and output transitional characteristics of the differential amplifier in the seventh embodiment of the present invention.
Figure 19B:
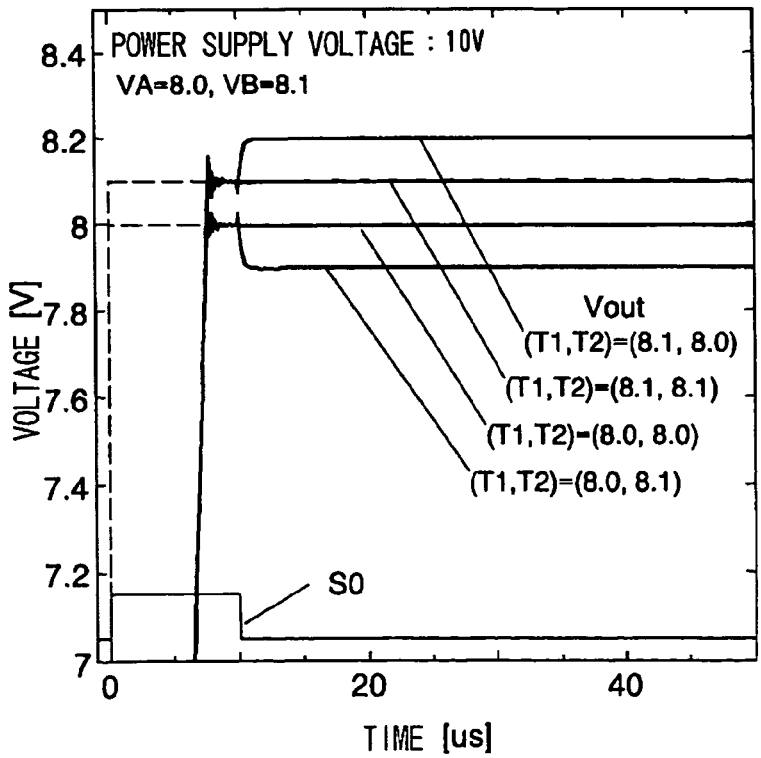
FIG. 19B is a partially enlarged view of FIG. 19A.

FIG. 19A is a graph showing output voltage waveforms (results of transitional analysis simulation) when the configuration in FIG. 17 and the method of controlling the switches in FIG. 18 are applied to the circuit for simulation in FIG. 11. FIG. 19B is a partially enlarged view of FIG. 19A.

Referring to FIG. 19, input conditions are basically set to be the same as those in FIG. 16. However, the switch control signal S0 is set to be high in the period t1 and set to be low in the period t2.

From the diagram in FIG. 19 showing the waveforms, it can be seen that in the period t1 in which the signal S0 is high, the slew rate is constant irrespective of the output levels.

Further, the two differential pairs (101, 102) and (103, 104) both function as voltage followers, the slew rate is also improved.

Then, in the period t2 in which the signal S0 is set to be low, the output voltage Vout changes to the voltage responsive to the voltages supplied to the input terminals (T1, T2).

Incidentally, variations (voltage differences) of the output voltage Vout in the period t2 are comparatively small. For this reason, the slew rates for the four output levels become substantially the same.

Further, control over the signal S0 can be performed at fixed timings. As described above, the differential amplifier in FIG. 17 can solve non-uniformity in the slew rate. Incidentally, the configuration (constituted from the switches 161 and 162) for compensating for the reduction of the slew rate, shown in FIG. 17 can also be applied to the differential amplifiers other than those shown in FIGS. 1 and 11 in the same manner. When the configuration is applied to the differential amplifier shown in FIG. 10, for example, the control terminals (gates) of the transistors 104 and 204 connected in common should be connected to the output terminal 3 and the input terminal T2 through the switches 161 and 162, respectively.

Next, a DAC (digital-to-analog converter) that uses each of the differential amplifiers described in the above-mentioned embodiments will be described.

First, a description will be given to the DAC in which the two input voltages (A, B) are selectively input to the input terminals T1 and T2 of the differential amplifier and four voltage levels (Vo1 to Vo4) are output.

FIG. 20 is a table explaining input and output correspondences of a two-bit data input DAC in which control over four inputs (selections) of the two input voltages (A, B) to the input terminals (T1, T2) is performed by two-bit data (D1, D0). In this case, the input voltages A and B are set to the second and third voltage levels, respectively.

Figure 21:
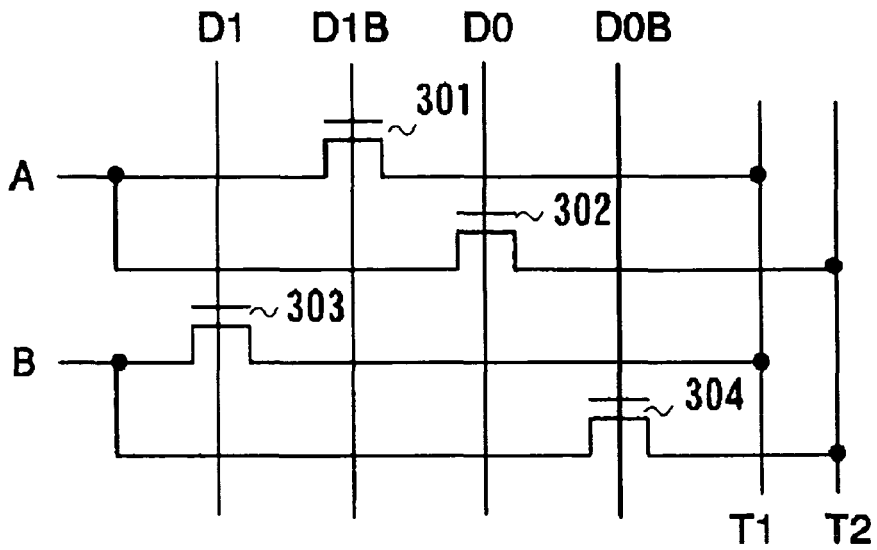
FIG. 21 is a diagram showing a configuration of a two-bit decoder for performing control shown in FIG. 20.

FIG. 21 is a diagram showing an example of a configuration of a two-bit decoder (composed by n-channel transistors) that can implement control shown in FIG. 20. FIG. 21 can be constituted from two input voltages and four transistors 201 to 204, thereby becoming a particularly simple configuration. Transistors 301 and 302 with their gates connected to D1B and D0 are included between the voltage A and the terminals T1 and T2. Transistors 303 and 304 with their gates connected to D1 and D0B are included between the voltage B and the terminals T1 and T2. When (D1, D0)=(0, 0), (0, 1), (1, 0), and (1,1), pairs of the transistors that are switched on become (301, 304), (301, 302), (303, 304), and (302, 303), respectively. Then, as shown in FIG. 20, (A, B), (A, A), (B, B) and (B, A) are transmitted to the terminals T1 and T2, respectively. Incidentally, the order of the respective bit signals (D1, D0) and their inverted signals may be arbitrary. Though a description about a Pch decoder is omitted, the replacement to the Pch decoder can be easily realized by changing the Nch decoder into the configuration in which digital data is inverted for input (or DX is inverted into DXB and DXB is inverted into DX, where X=0, 1 in FIG. 21).

Figure 22:
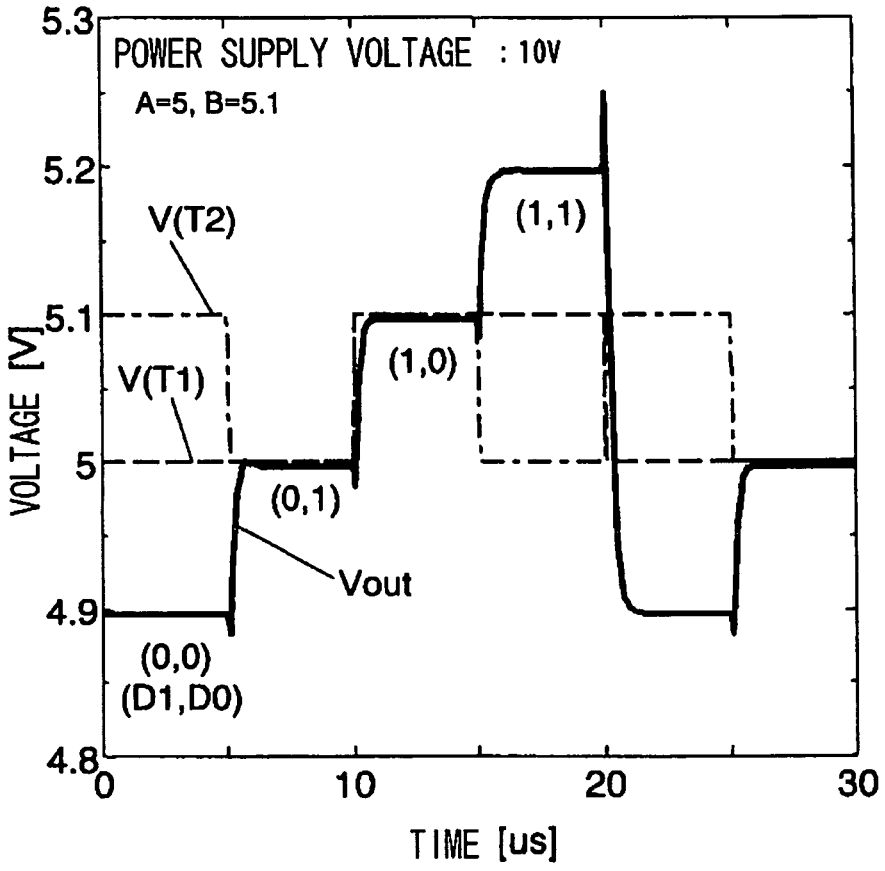
FIG. 22 is a graph showing an output voltage waveform of the DAC in the eighth embodiment of the present invention.

FIG. 22 is a diagram showing an output voltage waveform of the DAC in the eighth embodiment of the present invention, constituted from the decoder in FIG. 21 and the differential amplifier in FIG. 11. FIG. 22 shows the output waveform of the output voltage Vout of the differential amplifier when the two-bit data (D1 and D0) are changed one by one during a given period.

The input voltage A was set to 5V, while the input voltage B was set to 5.1 V, with their voltage difference being 0.1 V. From FIG. 22, it was confirmed that four levels at 0.1 V intervals (4.9 V, 5.0 V, 5.1 V, and 5.2 V) can be output with high precision in response to the two-bit data.

FIG. 23 is a table for explaining a ninth embodiment of the present invention, and is the table showing input and output correspondences of a four-bit data input DAC that uses the differential amplifier in the embodiment described before. Referring to FIG. 23, respective four levels of the total 16 levels are regarded as one block. The two input voltages set for each block are selected by high-order two bits (D3 and D2) of four-bit data, and selection of the two input voltages to the input terminals (T1 and T2) is made by low-order two bits (D1 and D0). The number of input voltages is eight (from A to H).

Figure 24:
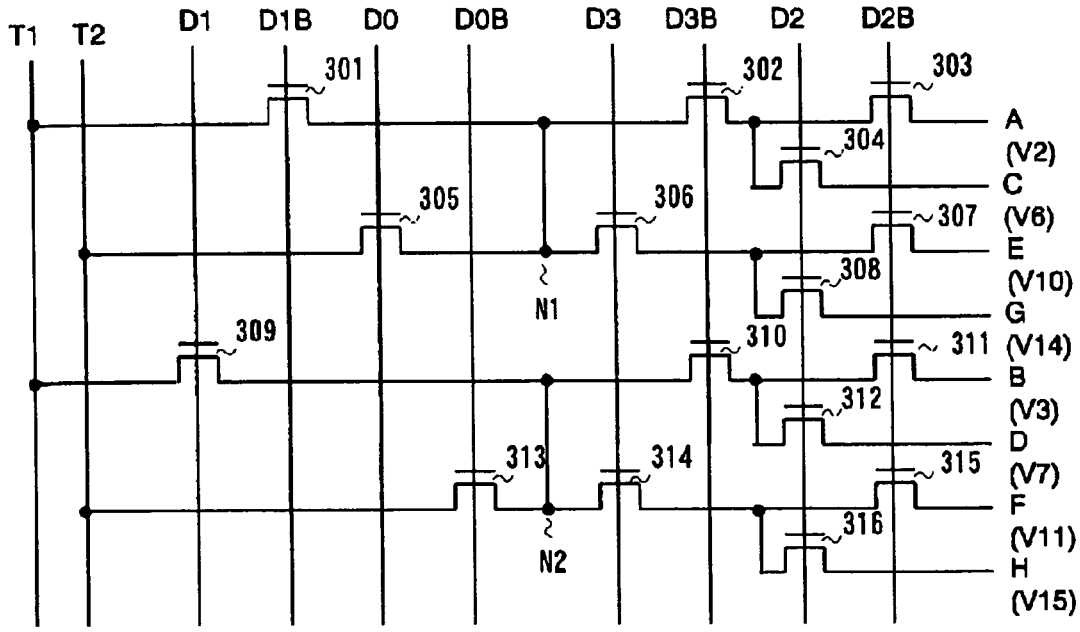
FIG. 24 is a diagram showing a configuration of a four-bit decoder for performing control shown in FIG. 23.

FIG. 24 is a diagram showing an example of a configuration of the four-bit decoder that can implement control shown in FIG. 23. FIG. 24 shows the example in which switches are constituted from n-channel transistors. As shown in FIG. 24, the four-bit decoder can be constituted from eight input voltages A to H and 16 transistors 301 to 316. Incidentally, in FIG. 24, n in Vn (in which n indicates 2, 6, 10, 14, 3, 7, 11, and 15) in respective brackets below the input voltages A, C, E, G, B, D, F, and H indicates the input voltage corresponding to a level n among the levels 1 to 16 in FIG. 23. Referring to FIG. 24, the four-bit decoder is constituted from a first selection unit and a second selection unit.

The first selection unit is constituted from transistors 302, 303, 304, 306, 307, 308, 310, 311, 312, 314, 315, and 316, and selects one of the input voltages (A, B), (C, D), (E, F) and (G, H) set for each block constituted from four levels according to the signals indicating high-order two bits (D3, D2), for output to nodes N1 and N2.

The second selection unit is constituted from transistors 301, 305, 309, and 313 and selects voltages to be output to the terminals T1 and T2 from the voltages output to the nodes N1 and N2, by the signals indicating low-order two bits (D1, D0). In FIG. 24, the second selection unit is the same as the configuration in FIG. 21, though the order in the bit signal (D1, D0) is interchanged. The terminals to which the input voltages A and B in FIG. 21 are applied should be replaced with the nodes N1 and N2. As described above, the decoder shown in FIG. 24 also has an extremely simple configuration. Incidentally, the order of the respective bit signals (D1 and D0) and the order of their inverted signals may be arbitrary.

Though FIG. 24 showed the example of the configuration of the four-bit decoder, a multi-bit decoder that decodes four bits or more is also constituted from the first and second selection units, in the same manner as described above.

That is, when 2×s input voltages for each block are set to the (4×k−2)th level and the (4×k−1)th level, in which k indicates one of integers from 1 to s, for 4×s voltage levels corresponding to bit data, in which s indicates a predetermined positive integer, the first selection unit selects the (4×j−2)th level and the (4×j−1)th level, in which j is one of the integers from 1 to s, according to the signals indicating the high-order bits excluding the signals indicating the low-order two-bits (D1 and D0) for output to the nodes N1 and N2, and selects the voltages to be output to the terminals T1 and T2 from the voltages output to the nodes N1 and N2 according to the signals indicating the low-order bits (D1 and D0). Even if the bit width of the bit signal is increased, the configuration of the second selection unit is made to be common, and the number of devices in the first selection unit increases.

Figure 38:
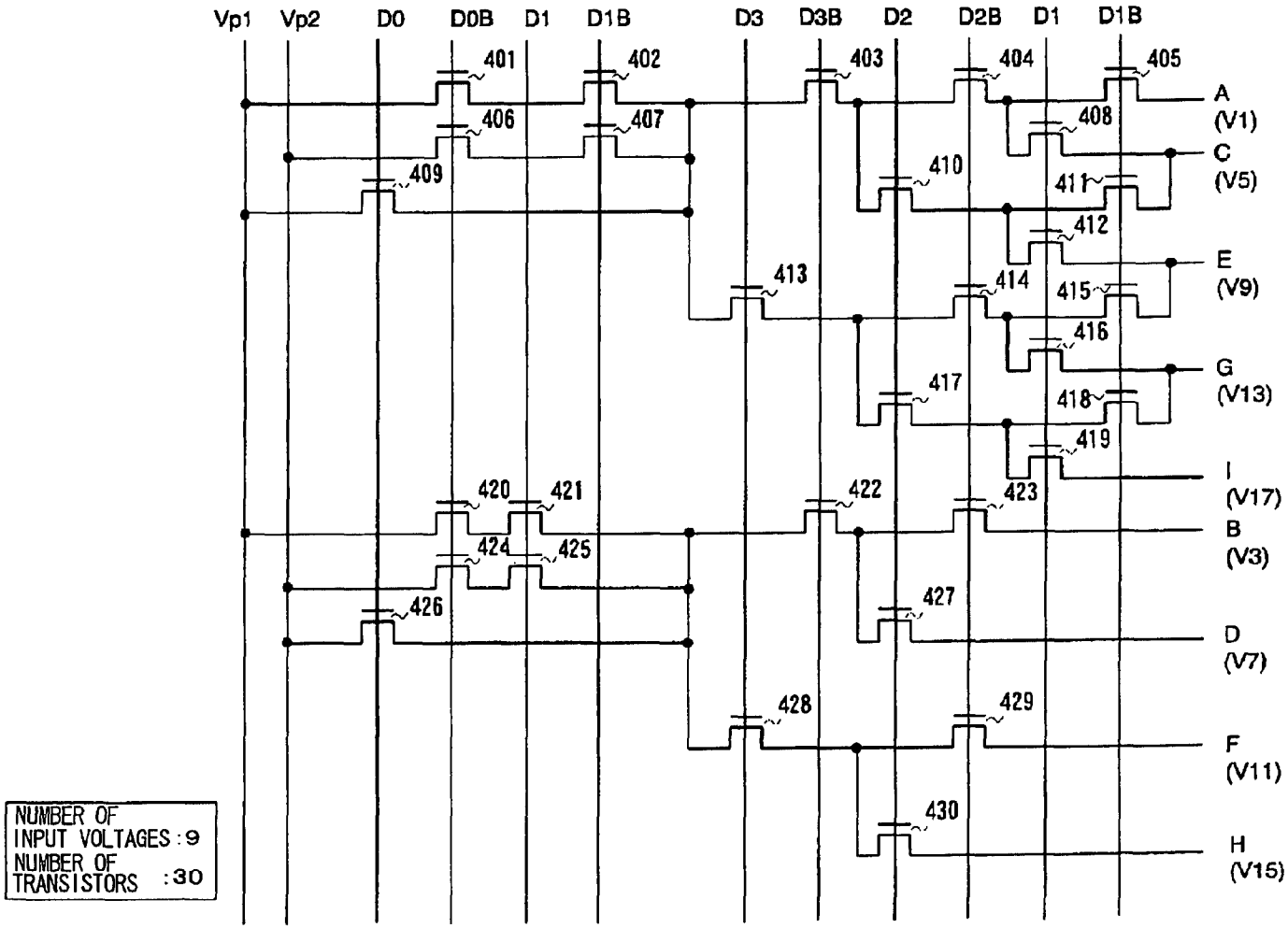
FIG. 38 PRIOR ART
FIG. 38 is a diagram showing a configuration of the decoder 987 in FIG. 31.
Figure 39:
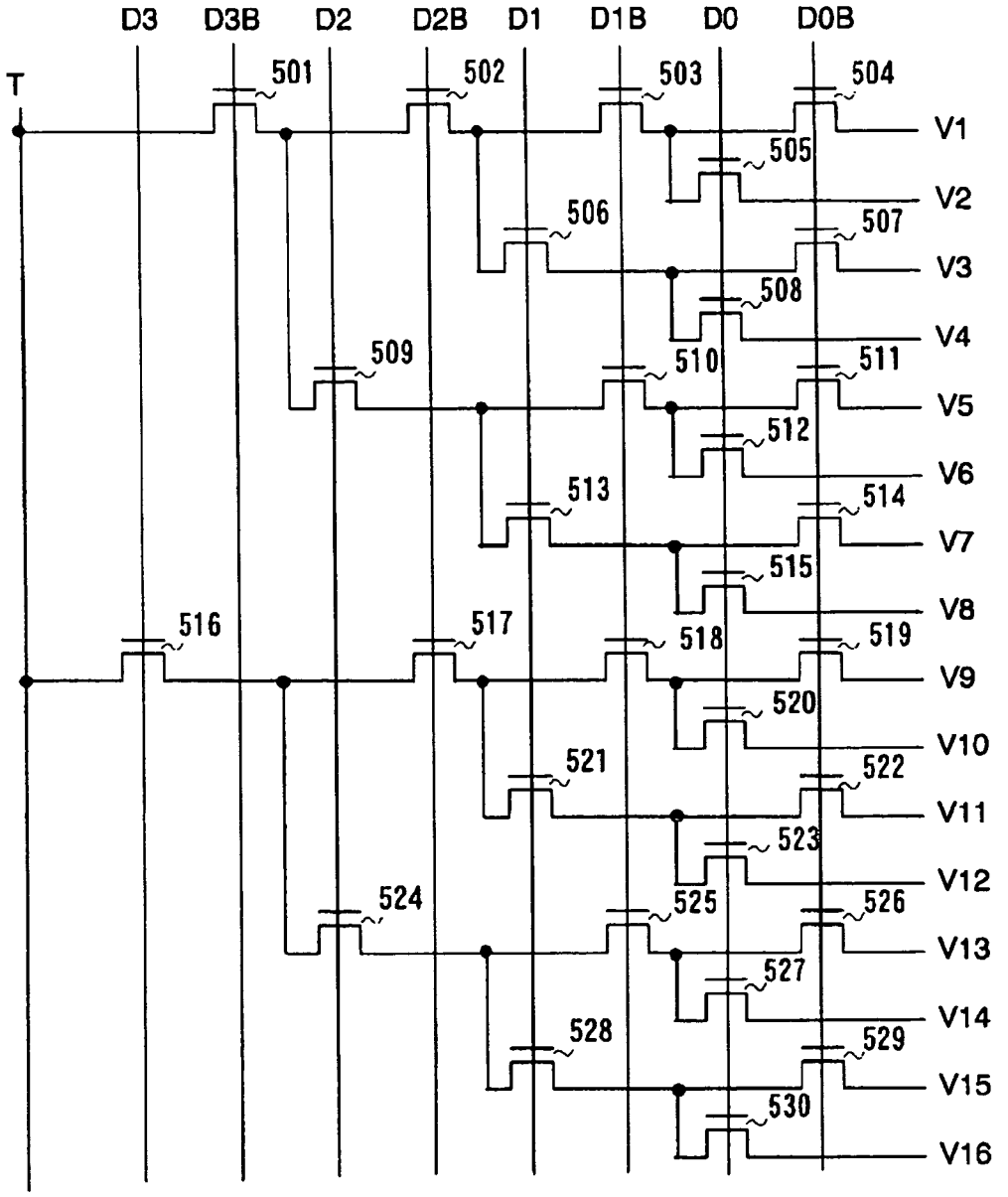
FIG . 39 PRIOR ART
FIG. 39 is a diagram showing a configuration of a decoder 984 in FIG. 30.

When the configuration of the four-bit decoder in this embodiment shown in FIG. 24 is compared with the configuration of the four-bit decoder shown in FIGS. 38 and 39, it can be seen that in this embodiment shown in FIG. 24, not only the number of input voltages is reduced, but also the number of the transistors constituting the decoder is greatly reduced. In the configuration shown in FIG. 38, the number of the input voltages is set to nine, and the number of the transistors is set to 30. In the configuration shown in FIG. 39, the number of the input voltages is set to 16, while the number of the transistors is set to 30. On contrast therewith, in this embodiment, the number of the input voltages is set to eight, and the number of the transistors is set to 16. Compared with the conventional configuration shown in FIGS. 38 and 39, the effect of reducing the voltages and the number of devices is manifest. That is, when this embodiment is compared with the configurations shown in FIGS. 38 and 39, it is apparent that the effect of area saving is higher in this embodiment. Likewise, it can be said that the decoder that inputs data of four bits or more has the effect of area saving.

Figure 25:
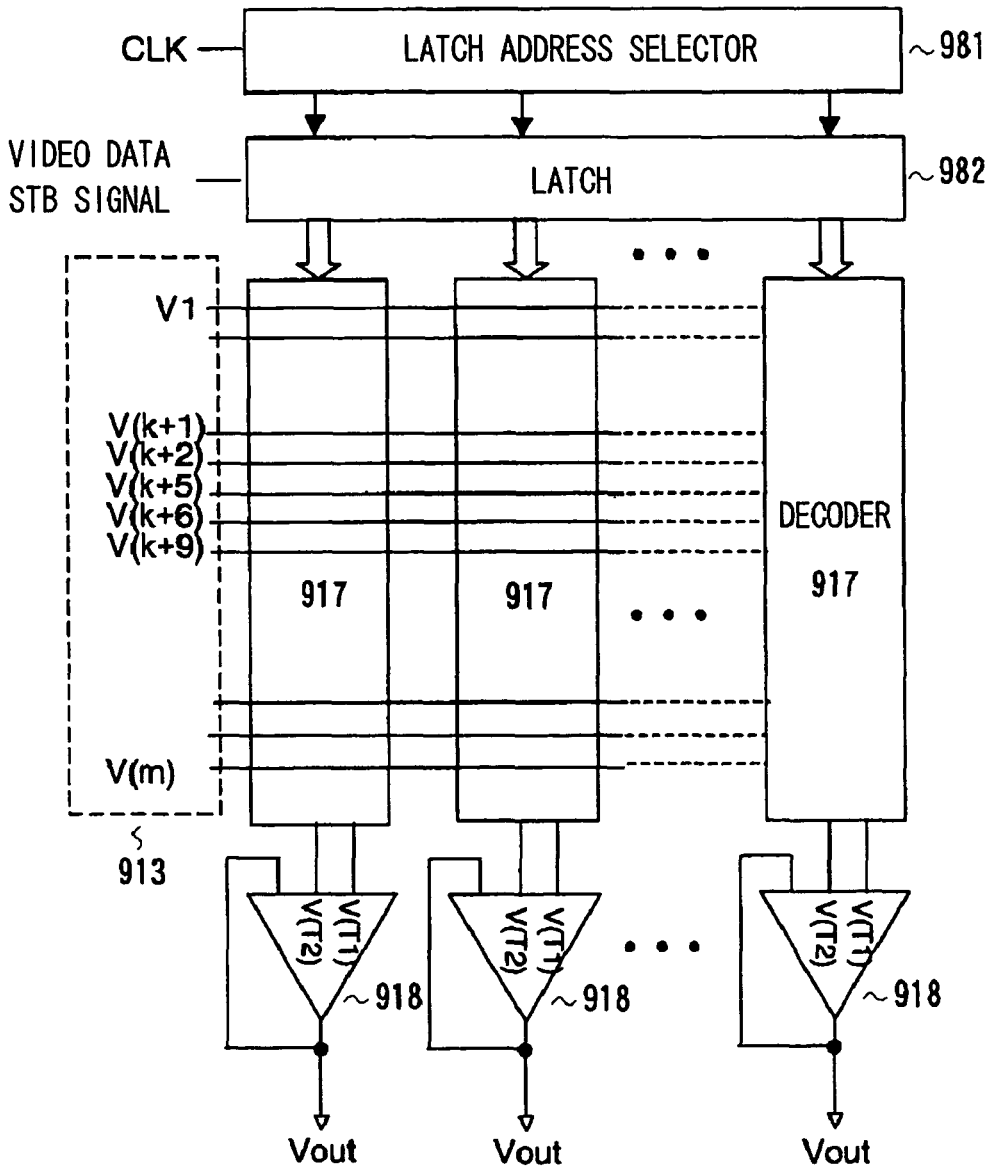
FIG. 25 is a diagram showing a data driver according to a tenth embodiment of the present invention.

FIG. 25 is a diagram showing a configuration of a tenth embodiment of the present invention. In this embodiment, the present invention is applied to the data driver in FIG. 31 described as the conventional art.

Figure 31:
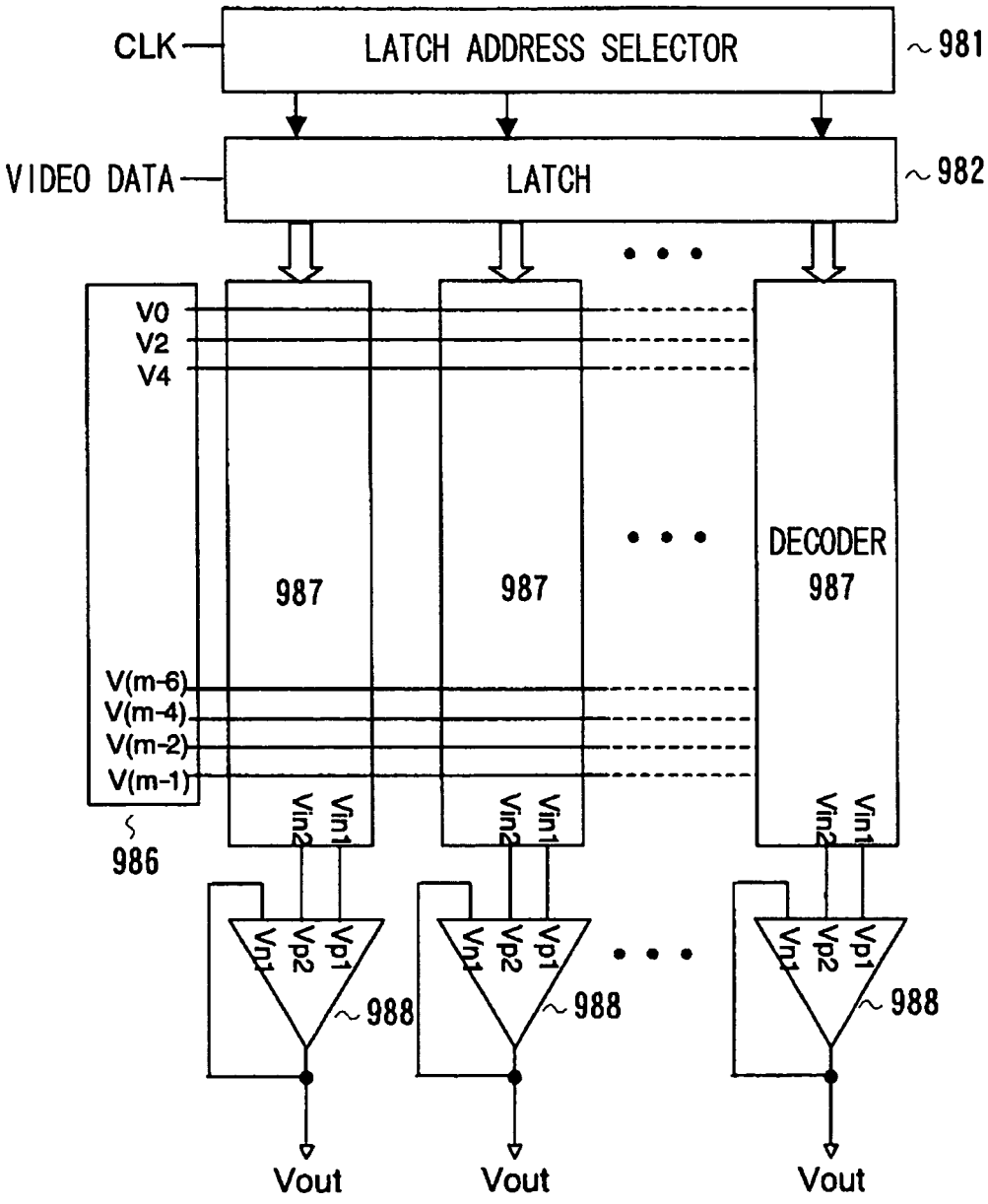
FIG . 31 PRIOR ART
FIG. 31 is a diagram showing a configuration of a data driver described in patent document 1.

Referring to FIG. 25, by applying the differential amplifier of the present invention to the data driver, respective configurations of a grayscale voltage generating circuit 913, a decoder 917, and a buffer circuit 918 are different from the grayscale voltage generating circuit 986, decoder 987, and buffer circuit 988 shown in FIG. 31. As described with reference to FIG. 24, the area of the decoder 917 in this embodiment is greatly reduced, compared with the area of the decoder 987.

Grayscale voltages generated by the grayscale voltage generating circuit 913 are set to the grayscale voltages for the second and third grayscales of every four consecutive grayscales (four consecutive grayscales per block).

The above description was given about the embodiments of the differential amplifier according to the present invention and the DACs that use it. The differential amplifiers and the DACs of the present invention can be configured not only as an LSI circuit formed on a silicon substrate but also as replacement by thin-film transistors without back gates, formed on a dielectric substrate such as glass or plastic.

Figure 29:
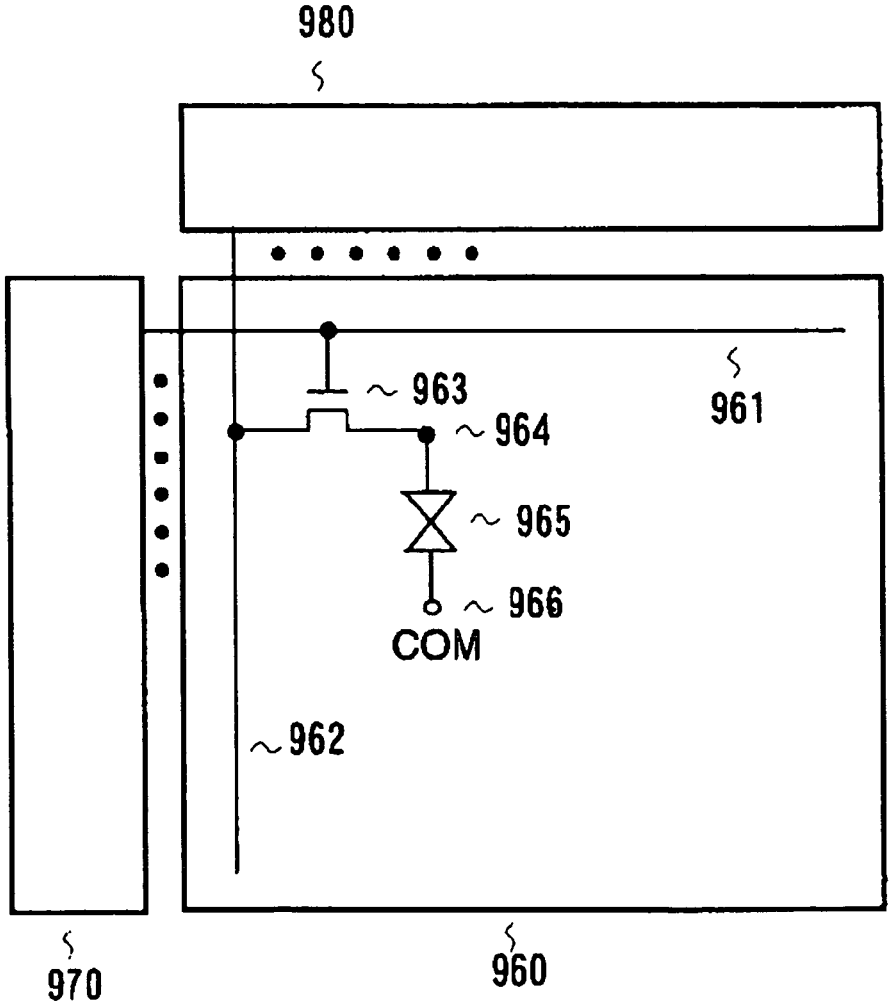
FIG . 29 PRIOR ART
FIG. 29 is a diagram showing a configuration of an active matrix liquid crystal device.

The data driver that uses the differential amplifier of the present invention as the buffer circuit can be used as the data driver 980 of the liquid crystal display device shown in FIG. 29.

Lower cost of the data driver 980 provided with the two-input four-output differential amplifier according to the present invention can be implemented by reducing the area of the decoder, and lower cost of the liquid crystal display device that uses it can also be implemented.

Figure 30:
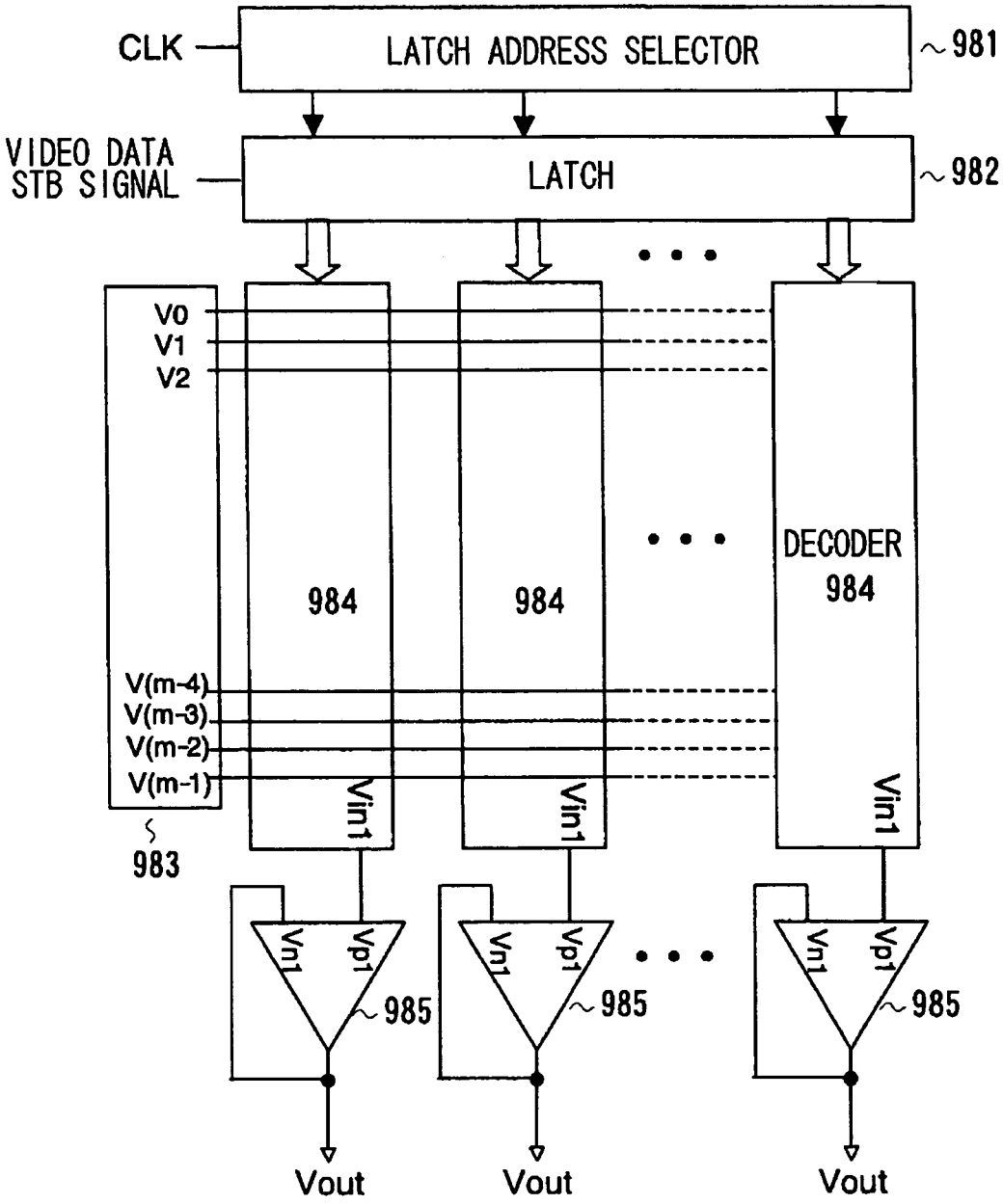
FIG . 30 PRIOR ART
FIG. 30 is a diagram showing a configuration of a data driver in FIG. 29.

In the liquid crystal device shown in FIG. 30, the data driver 980 may be formed separately as a silicon LSI and connected to the display unit 960. Alternatively, the data driver can be integrally formed with the display unit 960 by forming the circuit thereof using poly-silicon TFTs (thin-film transistors) on the dielectric substrate such as a glass substrate. Especially when the data driver is integrally formed with the display unit, the area of the data driver is reduced. A narrower frame (reduction of the width between the periphery of the display unit 960 and the periphery of the substrate) thereby also becomes possible.

By application of the differential amplifier according to the present invention to any data driver of such a display unit with other system, lower cost and the narrower frame of the display unit can be promoted. As in the liquid crystal display device, the differential amplifier according to the present invention can be of course applied to a display device such as an organic EL display with the active matrix driving system that performs display by outputting a multi-level voltage signal to a data line.

In the differential amplifier according to the present invention, the number of the differential pairs is not limited to two, as in the first embodiment shown in FIG. 1. A configuration including three or more differential pairs will be described below as an example of a variation of the above embodiments.

Figure 26:
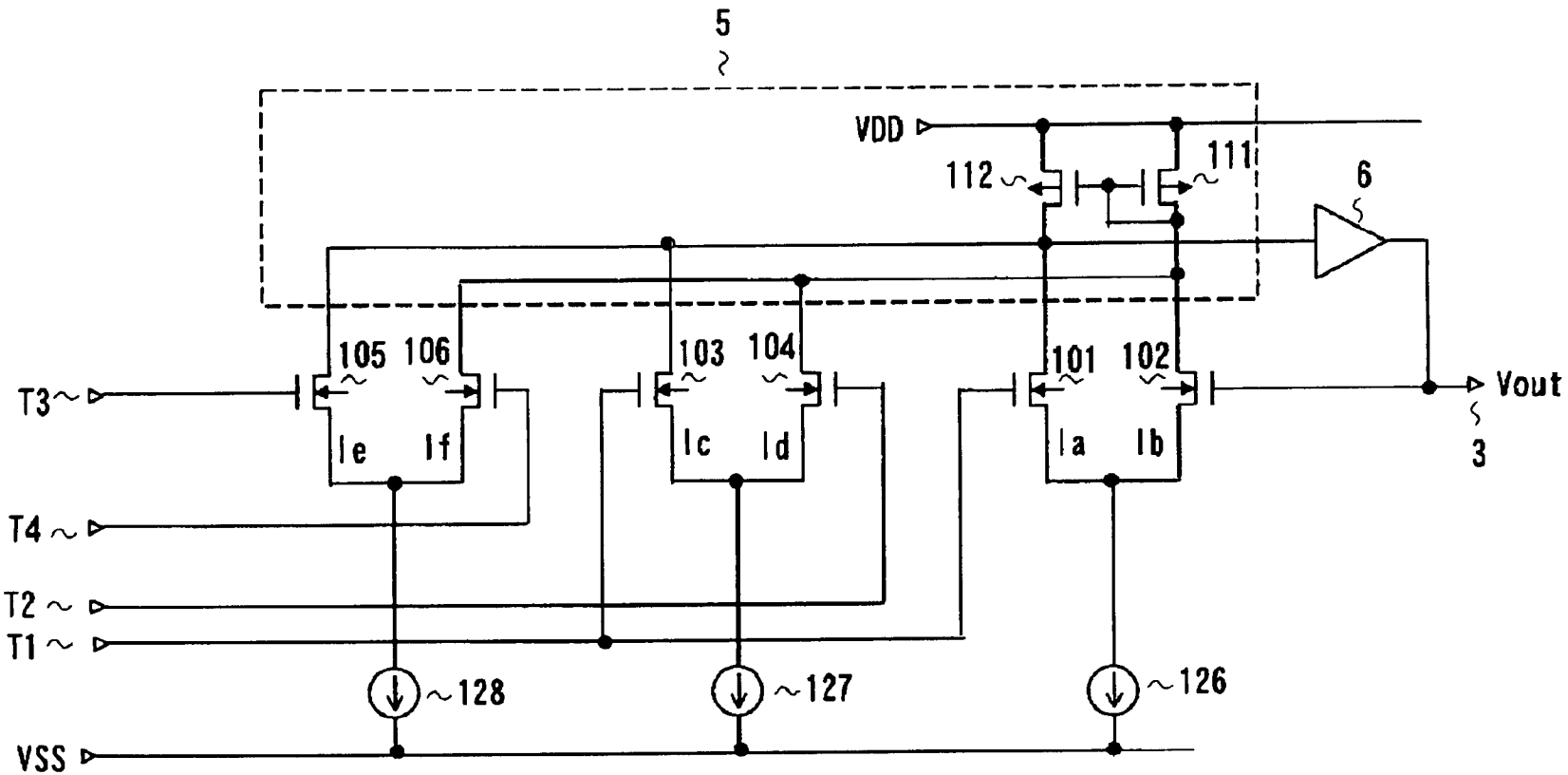
FIG. 26 is a diagram showing a configuration of a differential amplifier according to an eleventh embodiment of the present invention.

FIG. 26 is a diagram showing a configuration of an eleventh embodiment of the present invention. FIG. 26 shows an example of the configuration of the differential amplifier configured to include three or more differential pairs.

As shown in FIG. 26, the differential amplifier in this embodiment includes the first through fourth input terminals T1, T2, T3, and T4, output terminal 3, and the first through third differential pairs (n-channel transistor pairs (101, 102), (103, 104), and (105, 106)). One of the input pair of the first differential pair (101, 102) is connected to the first input terminal T1, and the other is connected to the output terminal 3. The input pair of the second differential pair (103, 104) is connected to the first input terminal T1 and the second input terminal T2, respectively. The input pair of the third differential pair (105, 106) is connected to the third input terminal T3 and the fourth input terminal T4, respectively.

The differential amplifier includes the first through third current sources (126, 127, 128) for supplying constant currents to the first through third differential pairs, the load circuit 5 connected to connecting points for ones of the output pairs of the first through third differential pairs and the others of the output pairs of the first through third differential pairs, and the amplification stage 6 with an input terminal thereof connected to the connecting points for ones of the output pairs of the first through third differential pairs (101, 102), (103, 104), and (105, 106) and an output terminal thereof connected to the output terminal 3. As voltages supplied to the first through fourth input terminals T1 to T4, divided voltage values output to the taps of a resistance string (not shown) connected between first and second reference voltages, for example, may be directly supplied to the respective terminals. Alternatively, the divided voltage values may be supplied to the respective terminals through a voltage follower circuit or the like.

The load circuit 5 is constituted from a current mirror circuit formed of the transistors 111 and 112, and the input and output of the current mirror circuit are connected in common to the respective output pairs of the first through third differential pairs. As illustrated in FIG. 9, the load circuit 5 may include first through third current mirror circuits that constitute separate loads on the first through third differential pairs. In this case, the output terminals of the first through third current mirror circuits are connected in common.

Figure 27:
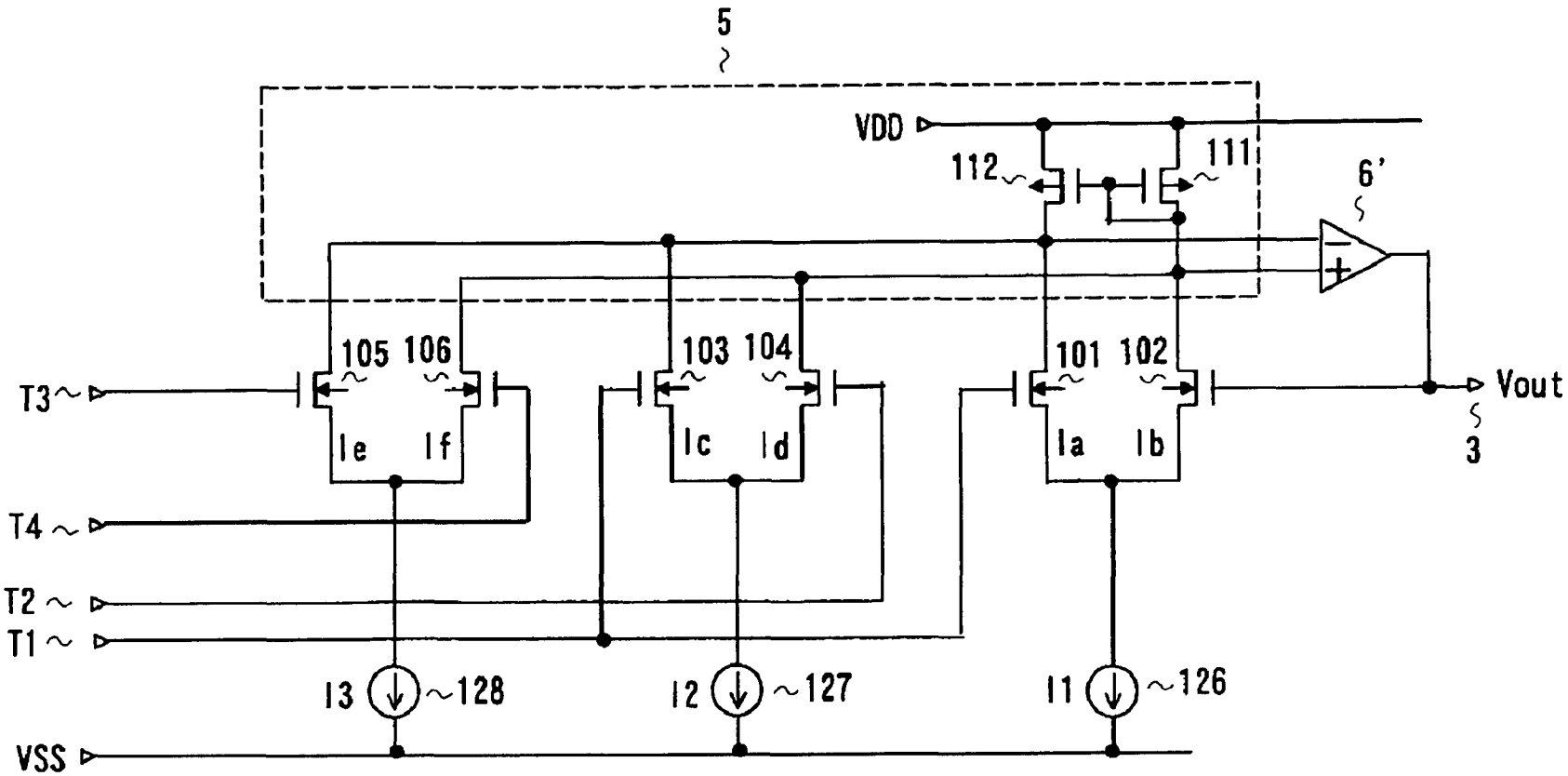
FIG. 27 is a diagram showing an example of a variation of the eleventh embodiment of the present invention.

FIG. 27 is a diagram showing an example of a variation of the eleventh embodiment of the present invention. This embodiment is different from the embodiment shown in FIG. 26 described before in the configuration of the amplification stage 6.

Referring to FIG. 27, this embodiment includes a differential amplification stage 6' with an input pair thereof connected to connecting points common to ones of the output pairs of the first through third differential pairs (101, 102), (103, 104), and (105, 106) and connecting points common to the others of the output pairs of the first through third differential pairs and an output terminal thereof connected to the output terminal 3. The action and effect of this embodiment is the same as the embodiment shown in FIG. 26 described before. The amplification stages 6 in FIG. 1, FIGS. 7 to 11, and FIG. 17 may be of course replaced by the differential amplification stage 6' in FIG. 27.

Figure 28:
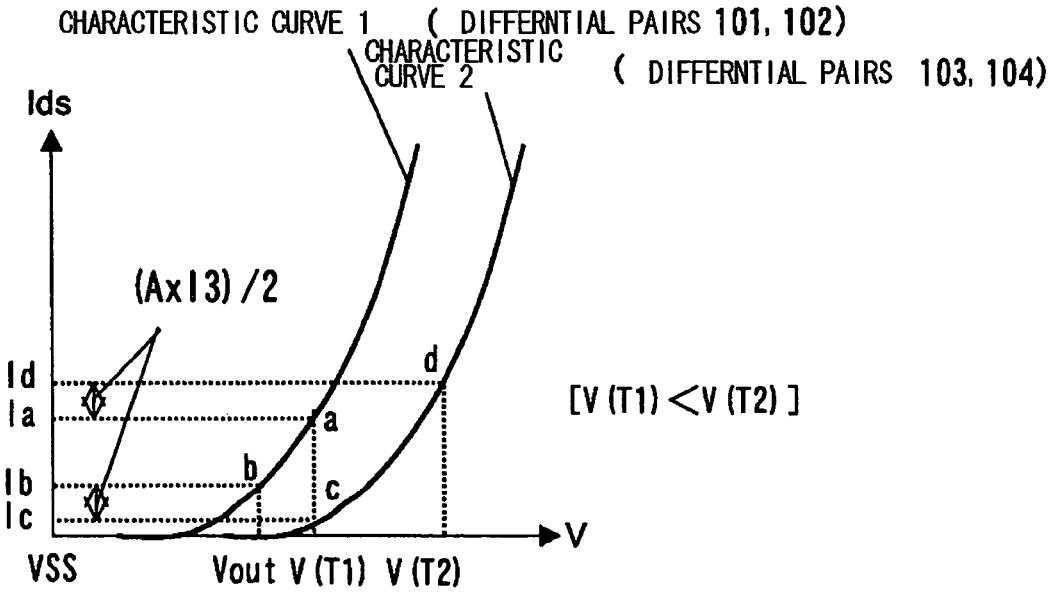
FIG. 28 is a graph for explaining an extrapolating operation of the differential amplifier in the eleventh embodiment using its current-voltage characteristics.

FIG. 28 is a graph for explaining operations of the differential amplifiers having three differential pairs, shown in FIGS. 26 and 27.

A V-I characteristic curve 1 shows the characteristic of the first differential pair (101, 102), while a V-I characteristic curve 2 shows the characteristic of the second differential pair (103, 104). When the currents that flow through the transistors 101, 102, 103, 104, 105, and 106 are indicated by Ia, Ib, Ic, Id, Ie, and If, respectively, and the current values for the current sources 126, 127, and 128 are indicated by I1, I2, and I3, the following Equations (21) to (23) hold:

$$Ia+Ib=I1 \tag{21}$$

$$Ic+Id=I2 \tag{22}$$

$$Ie+If=I3 \tag{23}$$

By the current mirror that constitutes the load circuit 5, (in which the input current for the current mirror is equal to the output current), the following Equation (24) holds:

$$Ia+Ic+Ie=Ib+Id+If \tag{24}$$

It is assumed that the I1 is equal to the I2, and a difference current between Ie and If and I3 satisfy the relation of the following Equation (26).

$$I1=I2=I0 \tag{25}$$

$$Ie-If=A\times I3 \tag{26}$$

From the Equations (21), (22), and (25), the following Equation (27) are derived:

$$Ia+Ic=2\times I0-(Ib+Id) \tag{27}$$

Accordingly, from the above Equations (24) and (25), the following Equation (28) is obtained:

$$Ia+Ic+A\times I3=Ib+Id \tag{28}$$

From the Equations (27) and (28), the following Equations (29) and (30) are derived:

$$Ib+Id=(2\times I0+A\times I3)/2 \tag{29}$$

$$Ia+Ic=(2\times I0-A\times I3)/2 \tag{30}$$

From the above Equations (29) and (30), the following condition is further derived:

$$Ib+Id=Ia+Ic+A\times I \tag{31}$$

Accordingly, from the above Equations (29) to (31), the drain-to-source current-voltage characteristic can take the state as shown in FIG. 28. More specifically, referring to FIG. 28, the operating points a and c can have the common V=V (T1), and the operating points b and d can take the states in which they have the currents Ib and Id higher than the current Ia of the operating point a and the current Ic of the operating point c by {(A×I3)/2}, respectively.

The operating points b and d in FIG. 28 thus can be regarded as the states in which they are subject to modulation by the current value {(A×I3)/2} alone. In the modulation amount {(A×I3)/2}, a coefficient A that satisfies the Equations (23) and (26) is determined from the terminal voltages V(T3), V(T4) and the constant current 13 in FIG. 27.

The modulation amount {(A×I3)/2} also depends on the voltage V(T3) at the third input terminal T3 and the voltage V(T4) at the fourth input terminal T4, and the V-I characteristics of the transistors.

As described above, when the number of the differential pairs is three or more, through the voltages V(T3) and V(T4) of the third input terminal T3 and the fourth input terminal T4, the external division ratio of the voltage V(T1) of the first input terminal T1 and the voltage V(T2) of the second input terminal T2 can be modulated from the ratio of one to two.

When the voltage V(T1) of the first input terminal T1 and the voltage V(T2) of the second input terminal T2 are changed, the external division ratio changes, even if the voltage V(T3) of the third input terminal T3 and the voltage V(T4) of the fourth input terminal T4 are constant (except when the V(T3) is equal to the V(T4)). When the V(T3) is equal to the V(T4), Ie becomes equal to the If, and (A×I3) becomes zero. Thus, the modulation amount {(A×I3)/2} becomes zero, so that the same characteristic as in the case where the number of the differential pairs is two is obtained.

The above description about the present invention was given in connection with the embodiments described above. The present invention is not limited to the above embodiments. Various variations and modifications which could be performed by those skilled in the art are of course included within the scope of the claims of the inventions of the present application.

The differential amplifiers described in the above embodiments are constituted from MOS transistors. The driving circuit of the liquid crystal display device may be constituted from MOS transistors (TFTs) formed of polycrystalline silicon, for example. Though the above embodiments showed the examples applied to the integrated circuit, the differential amplifiers can of course be applied to a configuration of discrete devices.

It should be noted that other objects, features and aspects of the present invention will become apparent in the entire disclosure and that modifications may be done without departing the gist and scope of the present invention as disclosed herein and claimed as appended herewith.

Also any combination of the disclosed and/or claimed elements, matters and/or items may fall under the modifications aforementioned.

What is claimed is:

1. An amplifier, comprising:

(a) first and second input terminals configured for receiving first and second input signals, respectively;

(b) an output terminal for outputting an output signal calculated as responsive to the first and second signals; and (c) a first differential stage including:

(1) a first differential pair of first conductive type formed of a first transistor having gate serving as a non-inverting input of the first differential pair and connected to the first input terminal and having a source connected to a first node, and a second transistor having a gate serving as an inverting input of said first differential pair and connected to the output terminal and having a source connected to the first node;

(2) a second differential pair of first conductive type formed of a third transistor having a gate serving as a non-inverting input of said second differential pair and connected to the first input terminal and having a source connected to a second node which is different from the first node, and a fourth transistor having a gate serving as an inverting input of said second differential pair connected to the second input terminal and having a source connected to the second node;

(3) a first current source configured for supplying current to the first node connected in common with the sources of the first and second transistors of said first differential pair;

(4) a second current source configured for supplying current to the second node connected in common with the sources of the third and fourth transistors of said second differential pair;

(5) a first load circuit comprising a current mirror having an output node thereof connected to coupled drains of said first and third transistors and having an input node thereof connected to coupled drains of said second and fourth transistors; and (6) an amplification stage configured for receiving an output from at least one of a first connection node of said drains of said first and third transistors and said output node of said current mirror, and a second connection node of said drains of said second and fourth transistors and said input node of said outputting said output signal and for outputting said output signal at said output terminal, wherein said first differential stage extrapolates said first and second input signal to produce the output signal having a level equivalent to subtracting one level of the second input final from twice a level of the first input signal, wherein in case the first and second signals supplied to said first and second input terminals are at second and third levels, respectively, among four different levels of first, second, third and fourth levels in the level order, the output signal at the first level is output from said output terminal;

in case the first and second signals supplied to said first and second input terminals are both at the second level, the output signal at the second level is output from said output terminal;

in case the first and second signals supplied to said first and second input terminals are both at the third level, the output signal at the third level is output from said output terminal; and in case the first and second signals supplied to said first and second input terminals are at the third and second levels, respectively, the output signal at the fourth level obtained by extrapolation of the third level and the second level at the ratio of one to two is output from said output terminal.

2. The amplifier according to claim 1, further comprising:

a current control circuit for adjustably controlling current of at least one of said first current source and said second current source.

* * * * *